US006761970B2

(12) United States Patent
Ochi et al.

(10) Patent No.: US 6,761,970 B2
(45) Date of Patent: Jul. 13, 2004

(54) POLY(LACTIC ACID) FIBER

(75) Inventors: Takashi Ochi, Mishima (JP); Takaaki Sakai, Mishima (JP); Yuhei Maeda, Mishima (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 10/207,571

(22) Filed: Jul. 29, 2002

(65) Prior Publication Data

US 2003/0054718 A1 Mar. 20, 2003

(30) Foreign Application Priority Data

Jul. 30, 2001 (JP) ..... 2001/230103
Sep. 28, 2001 (JP) ..... 2001/302704

(51) Int. Cl.[7] ..... D01F 6/00; C08G 6/08; C08L 67/04

(52) U.S. Cl. ..... 428/364; 428/394; 525/415; 528/254

(58) Field of Search ..... 428/364, 373, 428/394; 525/415; 528/254

(56) References Cited

U.S. PATENT DOCUMENTS

| | | | | |
|---|---|---|---|---|
| 5,010,145 A | * | 4/1991 | Ikada et al. | 525/415 |
| 5,698,322 A | * | 12/1997 | Tsai et al. | 428/373 |
| 6,306,499 B1 | * | 10/2001 | Ochi et al. | 428/364 |

FOREIGN PATENT DOCUMENTS

| | | | |
|---|---|---|---|
| EP | 1 215 225 A1 | | 6/1902 |
| EP | 1 036 865 A | | 9/2000 |
| JP | 8-226016 A | | 9/1996 |
| JP | 08-246247 | | 9/1996 |
| JP | 11-131323 A | | 5/1999 |
| JP | 11-293517 | | 10/1999 |
| JP | 2000-54228 A | | 2/2000 |
| JP | 2000-109664 A | | 4/2000 |
| JP | 2000-136439 A | | 5/2000 |
| JP | 2000-248426 A | | 9/2000 |
| JP | 2001-64375 A | | 3/2001 |
| JP | 2001-64400 A | | 3/2001 |
| JP | 2001-122954 A | | 5/2001 |
| JP | 2001-226821 A | | 8/2001 |
| JP | 2001-261797 A | | 9/2001 |
| JP | 2002-61021 A | | 2/2002 |
| JP | 2002212832 | * | 7/2002 |
| WO | WO94/07979 | | 4/1994 |
| WO | WO98/50611 | | 11/1998 |
| WO | WO 00/78839 A1 | | 12/2000 |

OTHER PUBLICATIONS

"Stereocomplex Formation Between Enantiomeric Poly(lactic acid)s. XI. Mechanical Properties and Morphology of Solution–Cast Films", H. Tsuji and WY. Ikada, *Polymer the International Journal for the Science and Technology of Polymers*, vol. 40, No. 24, 1999, pp. 6600–6708.

"Crystal Structure, Conformation, and Morphology of Solution–Spun Poly(L–lactide) Fibers", W. Hoogsteen et al, *Macromolecules*, vol. 23, 1990, pp. 634–642.

* cited by examiner

*Primary Examiner*—N. Edwards
(74) *Attorney, Agent, or Firm*—Piper Rudnick LLP

(57) ABSTRACT

A poly(lactic acid) fiber has a strength at 90° C. of equal to or more than 0.8 cN/dtex and exhibits significantly satisfactory mechanical properties at high temperatures as compared with conventional poly(lactic acid) fibers.

40 Claims, 15 Drawing Sheets

$10_3$ HELIX $3_1$ HELIX

EXAMPLE 1

CHEMICAL SHIFT(ppm)

EXAMPLE 2

CHEMICAL SHIFT (ppm)

2 μm

POLY(LACTIC ACID) FIBER

BACKGROUND OF THE INVENTION

1. Field of the Invention

The present invention relates to poly(lactic acid) fibers having satisfactory mechanical properties at high temperatures.

2. Description of the Related Art

Strong demands have been made on polymer materials that are decomposed in the environment and are thereby environmentally friendly. As possible candidates therefor, aliphatic polyesters and other polymers have been investigated, developed and been launched. Among them, polymers that are decomposed by microorganisms, i.e., biodegradable polymers have become a focus of attention.

Most of conventional polymers are made from petroleum resources. However, the petroleum resources are limited and will probably be exhausted in the future. In addition, the petroleum resources are derived from hydrocarbons in fossils in a geologic age and have been accumulated in the ground, and heavy consumption and burning of the petroleum resources invites emission of carbon dioxide into the atmosphere to thereby cause global warming. If polymers can be synthesized from vegetable resources that take in carbon dioxide from the atmosphere for their growth, such vegetable-origin polymers are expected to decrease carbon dioxide in the atmosphere as a result of "carbon dioxide circulation" and to solve problems of the exhaustion of the petroleum resources. Polymers derived from the vegetable resources, i.e., biomass-derived polymers have therefore received attention.

Such biomass-derived biodegradable polymers receive great attention and are expected to be an alternative to conventional polymers derived from the petroleum resources. However, such biomass-derived biodegradable polymers generally have insufficient mechanical properties and heat resistance and require high cost for their production. The most noteworthy polymer as a biomass-derived biodegradable polymer that can solve these problems is poly(lactic acid). The poly(lactic acid) is a polymer derived from lactic acid, which lactic acid can be obtained by fermenting starch extracted from vegetable. The poly(lactic acid) has the best balance in mechanical properties, heat resistance and cost among such biomass-derived biodegradable polymers. Fibers using the poly(lactic acid) have been developed at a feverish pace.

However, even the most promising poly(lactic acid) has some disadvantages as compared with the conventional polymers. One of serious disadvantages is insufficient mechanical properties at high temperatures. The phrase "insufficient mechanical properties at high temperatures" used herein means that the poly(lactic acid) rapidly becomes soft at temperatures exceeding 60° C., i.e., the glass transition temperature ($T_g$) of the poly(lactic acid). With reference to FIG. 3, when a conventional poly(lactic acid) fiber is subjected to a tensile test at different temperatures, the poly(lactic acid) fiber rapidly becomes soft at temperatures in the vicinity of 70° C. or higher and becomes nearly fluid and exhibits markedly deteriorated dimensional stability at 90° C. In contrast, a fiber of nylon 6 (polyamide 6), a conventional polymer, does not become soft so rapidly and exhibits sufficient mechanical properties even at 90° C.

The poly(lactic acid) fiber has insufficient mechanical properties such as strength and creep resistance at high temperatures as mentioned above and actually invites problems. For example, when the poly(lactic acid) fiber is used as the warp of woven fabrics, the warp is sized and dried with hot air for better condensing and better weaving. However, upon hot air drying, the warp poly(lactic acid) fiber elongates by action of tension applied to stretch the warp taut. When products made from the poly(lactic acid) fiber are used in a high-temperature atmosphere, they have some problems in their durability. For example, Kogyo Zairyo (Industrial Materials), No. 6, p82 (2001) mentions that the inside temperature of cars in summer reaches 72° C. on the surface of a front seat and 80° C. on the surface of an upper side of a rear seat. When the poly(lactic acid) fiber is used as a fabric for car seats, the resulting car seats have insufficient durability, since the surface temperatures of car seats exceed $T_g$ of the material poly(lactic acid).

These problems significantly limit the applications of the poly(lactic acid) fiber. Accordingly, demands have been made on poly(lactic acid) fibers having improved mechanical properties at high temperatures.

Japanese Unexamined Patent Application Publication No. 2000-248426 discloses a high-strength yarn obtained by multistage drawing of a poly(lactic acid) undrawn yarn formed by low-velocity spinning. However, the results in further testing made by the present inventors show that even a high-strength yarn having a strength of 7 cN/dtex obtained by multistage drawing does not have practically satisfactory mechanical properties at high temperatures (Comparative Example 1). However, differences in mechanical properties at high temperatures cannot be explained by strength at room temperature alone, since such a high-strength poly (lactic acid) yarn has insufficient mechanical properties at high temperatures, but a high-strength poly(ethylene terephthalate) yarn has satisfactory mechanical properties at high temperatures. Thus, insufficient mechanical properties at high temperatures are unique to the poly(lactic acid) fibers.

SUMMARY OF THE INVENTION

Accordingly, it is an object of the present invention to provide a poly(lactic acid) fiber having satisfactory mechanical properties at high temperatures.

Specifically, the present invention provides, in an aspect, a poly(lactic acid) fiber having a strength at 90° C. of equal to or more than 0.8 cN/dtex.

The present invention further provides, in another aspect, process for producing a poly(lactic acid) fiber. The process includes the step of drawing a poly(lactic acid) undrawn yarn at such a drawn ratio (DR) as to satisfy the following condition:

$$0.85+(EL/100)\leqq DR\leqq 2.0+(EL/100)$$

wherein EL is the elongation (%) of the undrawn yarn.

DESCRIPTION OF THE PREFERRED EMBODIMENTS

Figure 1:
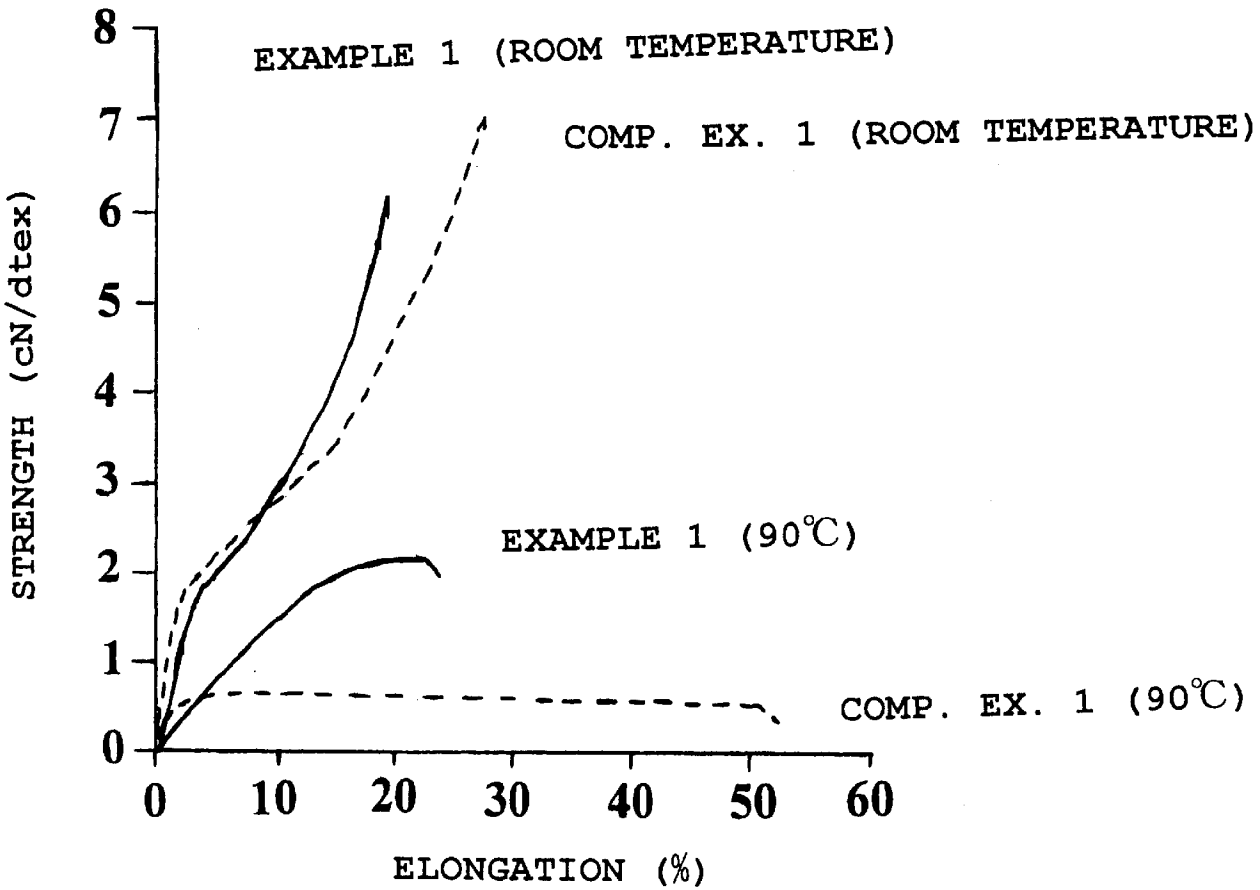
FIG. 1 illustrates plots of strength versus elongation at room temperature and at 90° C. on Example 1 and Comparative Example 1 (a conventional high strength poly(lactic acid) fiber)

The term "poly(lactic acid)" as used herein means and includes polymers obtained by polymerization of lactic acid. Such poly(lactic acid) include poly(L-lactic acid) and poly (D-lactic acid), and the optical purity thereof is preferably equal to or more than 90% for higher melting point. The term "poly(L-lactic acid) (PLLA)" as used herein means a poly(lactic acid) having an optical purity in terms of L-lactic acid of equal to or more than 90%, and the term "poly(D-lactic acid) (PDLA)" means a poly(lactic acid) having an optical purity in terms of D-lactic acid of equal to or more than 90%. The poly(lactic acid) may be a copolymer of lactic acid with another comonomer or may further comprise the other polymers than poly(lactic acid), as well as lubricants, flame retarders, antistatic agents and other additives within ranges not deteriorating the properties of the poly(lactic acid). Specifically, the poly(lactic acid) should preferably further comprise a lubricant when the resulting poly(lactic acid) fiber is used in applications which require wear resistance, since the poly(lactic acid) fiber has low wear resistance. As such lubricants, carboxylic amides are preferred, of which carboxylic amides having a high melting point are typically preferred. Such carboxylic amides having a high melting point are resistant to thermal decomposition and bleed out during process steps from spinning to fabric processing. From the viewpoints of biomass utilization and biodegradability, the poly(lactic acid) preferably comprises a lactic acid monomer as a monomer component in an amount of equal to or more than 50% by weight, preferably equal to or more than 75% by weight, and more preferably equal to or more than 96% by weight. The poly(lactic acid) preferably has a weight average molecular weight of 50000 to 500000 for well-balanced mechanical properties and stabilizing yarn-producing.

Such poly(lactic acid) for use in the present invention can be obtained, for example, according to processes described in PCT International Publications No. WO94/07949 WO94/07949 and No. WO98/50611, Japanese Unexamined Patent Application Publications No. 2001-261797, No. 2001-64375, No. 2001-64400, and No. 2001-122954.

To improve mechanical properties at high temperatures to thereby avoid elongation of yarn during sizing and drying procedures and to improve durability of the products in a high-temperature atmosphere, the poly(lactic acid) fiber must have a strength at 90° C. of equal to or more than 0.8 cN/dtex. The strength at 90° C. is preferably equal to or more than 1.0 cN/dtex, more preferably equal to or more than 1.3 cN/dtex, and typically preferably equal to or more than 1.5 cN/dtex.

The poly(lactic acid) fiber of the present invention preferably has a creep rate at 90° C. of less than or equal to 15%. The creep rate at 90° C. can be determined by subjecting a sample fiber to a tensile test at 90° C., plotting strength against elongation, and reading the elongation at a stress of 0.7 cN/dtex. Such a poly(lactic acid) fiber having a creep rate at 90° C. of less than or equal to 15% can have further improved dimensional stability at high temperatures. The creep rate at 90° C. is more preferably less than or equal to 10% and further preferably less than or equal to 6%.

If the poly(lactic acid) fiber exhibits large unevenness of yarn, the resulting fibrous products have deteriorated appearance quality and frequently invite fluff, slack and other defects. When the poly(lactic acid) fiber is used as a multifilament, it is generally subjected to aftertreatment for dying or for imparting functional substances. If the poly (lactic acid) fiber exhibits large unevenness of yarn in this case, it tends to cause dyeing speck and other unevenness in processing. To avoid these problems, an poly(lactic acid) yarn constituting the poly(lactic acid) fiber of the present invention has Uster unevenness (U %) of preferably less than or equal to 1.5%, and more preferably less than or equal to 1.2%. The Uster unevenness is an index of unevenness in yarn thickness of a yarn.

To further improve processability during process steps for manufacture of fibrous articles and to further improve the mechanical properties of the products, the poly(lactic acid) fiber of the present invention has a strength at 25° C. of preferably 2 cN/dtex, more preferably 3.5 cN/dtex, and further preferably equal to or more than 5 cN/dtex.

To improve processability during process steps for manufacture of fibrous articles, the poly(lactic acid) fiber of the present invention preferably has an elongation at 25° C. of from 15% to 70%.

The boiling water shrinkage of the poly(lactic acid) fiber is preferably from 0% to 20%, and more preferably from 2% to 10% to improve dimensional stability of the fiber and the resulting fibrous articles.

Poly(lactic acid) fibers herein are not specifically limited as long as they have the satisfactory physical properties as mentioned above. However, more preferred embodiments of the present invention are a poly(lactic acid) fiber having a specific fiber structure and a polymer blend fiber comprising a blend of a poly(lactic acid) and an aromatic polyester.

At first, the poly(lactic acid) fiber having a specific structure will be illustrated in detail below. This type of poly(lactic acid) fiber comprises a poly(D- or L-lactic acid) molecular chain constituting a $3_1$ helical structure by itself.

The $3_1$ helical structure will be illustrated in detail below.

Figure 4:
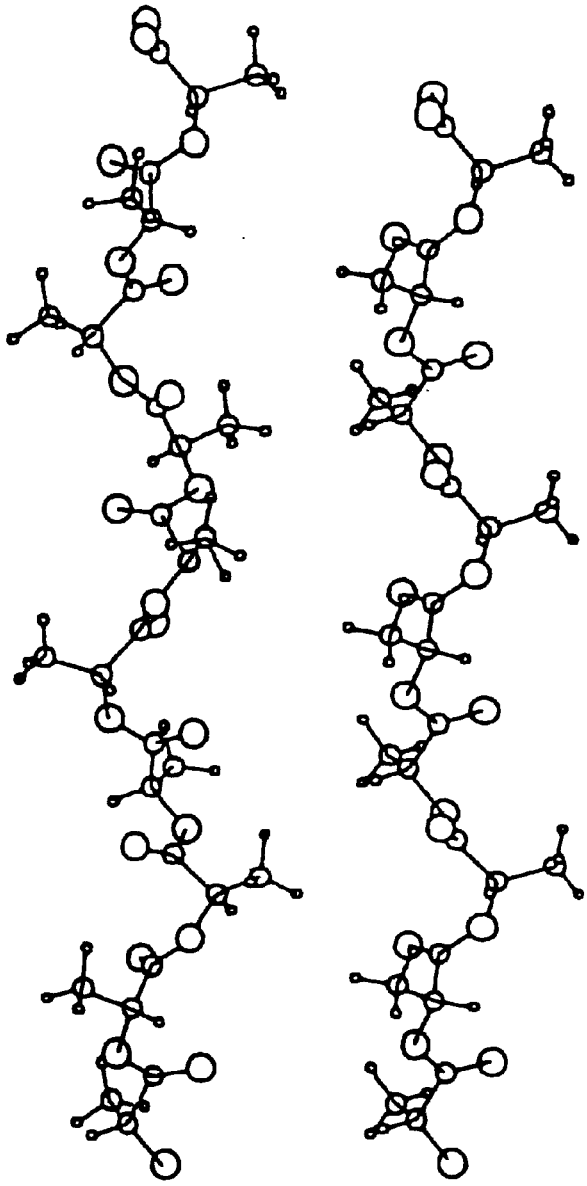
FIG. 4 illustrates helical structures of poly(lactic acid) molecular chains.

The structure of molecular chain in a regular poly(lactic acid) fiber will be described. The poly(lactic acid) fiber is usually of an alpha crystal form in which the molecular chain has a $10_3$ helical structure as described in J. Biopolym., vol. 6, 299 (1968). With reference to FIG. 4, the $10_3$ helical structure means a helical structure of which helix rotates three times per ten monomer units. In contrast, another type of poly(lactic acid) fiber comprises a beta crystal different from the alpha crystal, as described in Macromolecules, vol. 23, 642 (1990). This type of poly (lactic acid) fiber is obtained in the following manner. An ultrahigh molecular weight poly(lactic acid) having a viscosity average molecular weight of $56\times10^4$ to $100\times10^4$ is dissolved in a chloroform-toluene solvent mixture, the resulting solution is subjected to solution spinning at a spinning speed of 1 to 7 m/min to yield fibers, and the fibers are drawn at an ultrahigh temperature of 204° C. higher than the melting point at an ultrahigh draw ratio of 12 to 19 at a drawing speed of less than or equal to 1.2 m/min. The beta crystal has a $3_1$ helical structure (FIG. 4) of which helix rotates once per three monomer units (Macromolecules, vol. 23, 642 (1990)). From another viewpoint, the $3_1$ helical structure is a helical structure of which helix rotates three times per nine monomer units and is a stressed crystal obtained by stretching the $10_3$ helical structure to some extent.

Figure 5:
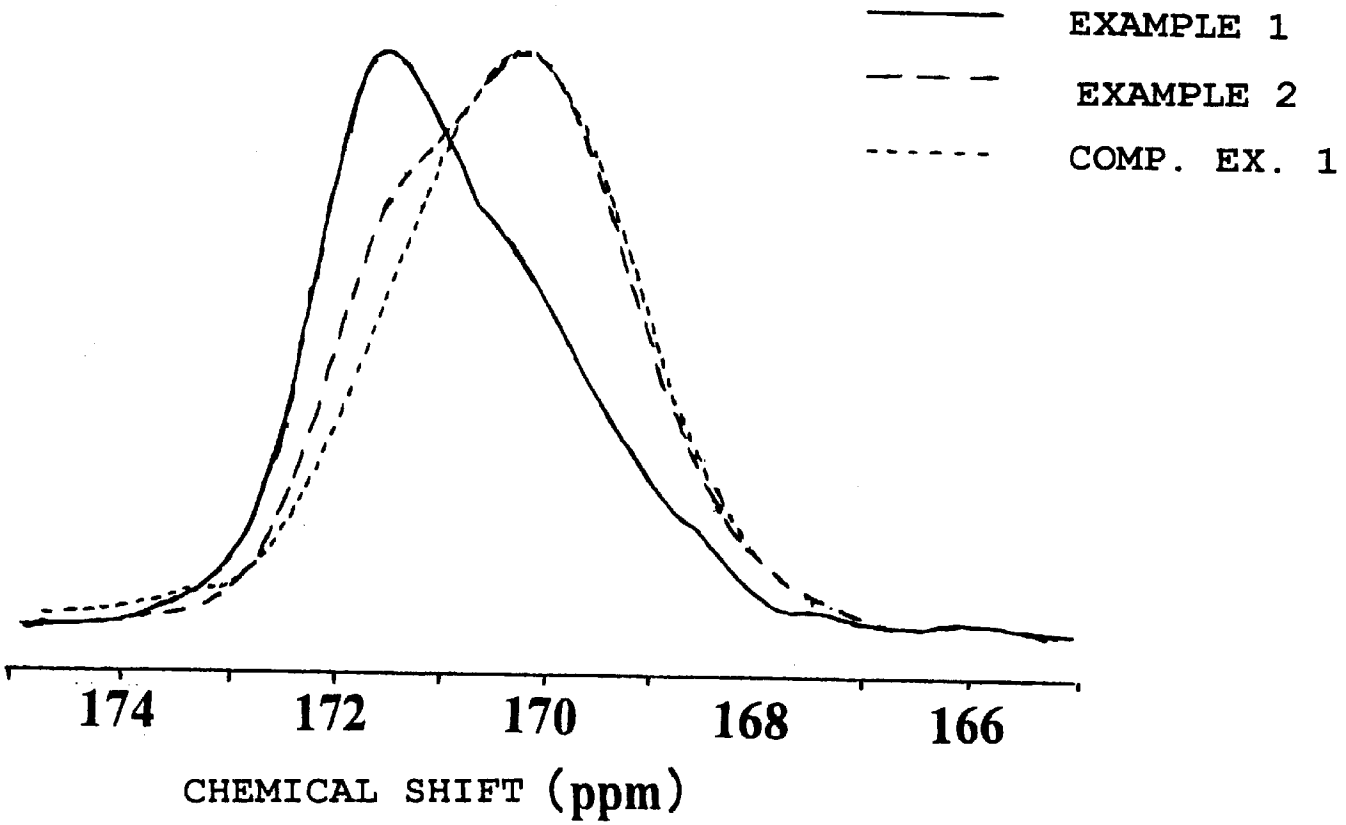
FIG. 5 shows solid state NMR spectra of high strength poly(lactic acid) fibers according to the present invention (Examples 1 and 2) and the conventional high-strength poly(lactic acid) fiber (Comparative Example 1)
Figure 7:
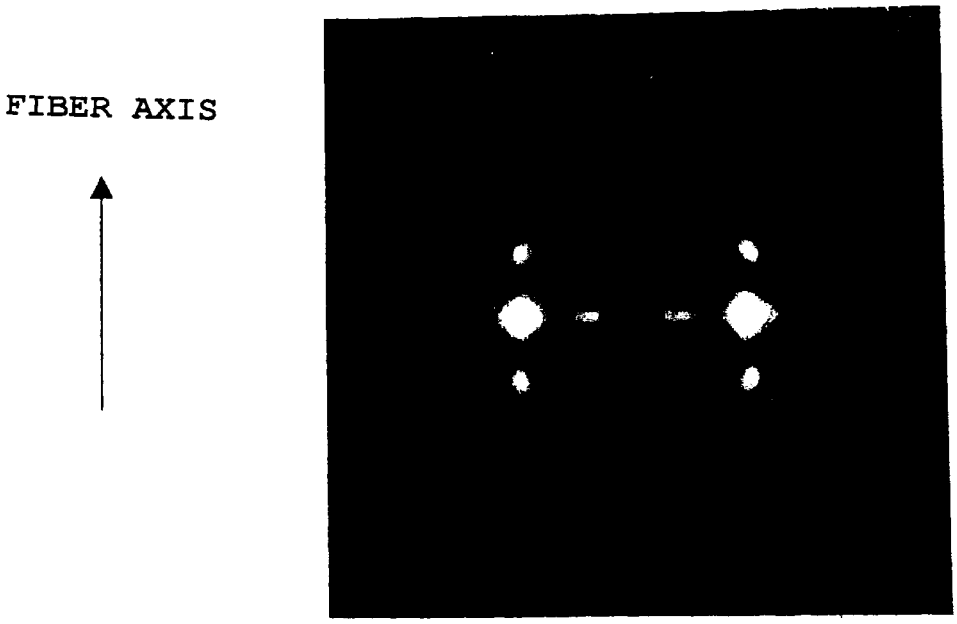
FIG. 7 illustrates a wide angle X-ray diffraction pattern of Example 1.

Based on solid state $^{13}$C-NMR analyses, the present inventors have found that conventional poly(lactic acid) fibers only show a peak in the vicinity of 170.2 ppm corresponding to the $10_3$ helical structure but the poly(lactic acid) fiber of the present invention shows a peak at 171.6 ppm, lower than 170.2 ppm, as shown in FIG. 5. The results demonstrate that the poly(lactic acid) fiber of the invention has a helical structure significantly different in configuration from the $10_3$ helical structure of the conventional poly(lactic acid) fibers. It has been verified that the helical structure in question is a $3_1$ helical structure, since a pattern analogous to that of beta crystal is observed in wide angle X-ray diffractometry (WAXD) (FIG. 7). Specifically, the present inventors have found that a peak observed in the vicinity of 171.6 ppm in solid state $^{13}$C-NMR analysis means that the $3_1$ helical structure is formed.

The poly(lactic acid) fiber of the present invention has only to comprise the $3_1$ helical structure at least partially. The integrated intensity of a peak corresponding to the $3_1$ helical structure ($3_1$ ratio) occupies preferably equal to or more than 12% of that of peaks observed at 165 to 175 ppm in a solid state $^{13}$C-NMR spectrum. The resulting poly(lactic acid) fiber can have a strength at 90° C. of equal to or more than 1.0 cN/dtex. The $3_1$ helical structure is not necessarily crystallized, but is preferably crystallized to such an extent as to be observed in WAXD images as in FIG. 7. By this configuration, the resulting poly(lactic acid) fiber can have a strength at 90° C. of equal to or more than 1.5 cN/dtex in some case.

The phrase "a L- or D-poly(lactic acid) molecular chain constitutes a $3_1$ helical structure by itself" means a state in which the PLLA moiety or PDLA moiety constitutes the $3_1$ helical structure independently and is distinguished from the state in which a pair of the PLLA moiety and PDLA moiety constitutes a $3_1$ helical structure as in a "stereocomplex".

The aforementioned poly(lactic acid) fiber obtained by drawing the solution-spun fiber at an ultrahigh draw ratio of 12 to 19 at an ultrahigh temperature of 204° C. higher than its melting point described in Macromolecules, vol. 23, 642 (1990) has U % of equal to or more than 10% and is not practically used as a yarn. This is for the following reasons. Specifically, in this technique, the undrawn yarn is spun from a solution, but the resulting undrawn yarn exhibits unevenness of yarn, since the solvent usually extracts from the surface of the fiber during such solution spinning, and depressions and protrusions occur on the surface of the fiber to thereby cause unevenness of yarn. The undrawn yarn is then drawn at an ultrahigh temperature higher than its melting point, but the constitutive yarn partially melts during drawing process and cannot be drawn homogeneously to thereby further cause unevenness of yarn. In addition, the yarn is drawn at such an ultrahigh draw ratio of equal to or more than 12 and cannot be drawn stably to thereby further invite unevenness of yarn. Additionally, the spinning speed and drawing speed are excessively low, and the fiber becomes susceptible to disturbance during drawing, thus further increasing unevenness of yarn.

Processes for producing the poly(lactic acid) fiber of the present invention include, but are not specifically limited to, a process in which an oriented and crystallized poly(lactic acid) fiber is drawn at a high draw ratio as described below.

In the process just mentioned above, setting of the draw ratio (DR) is typically important, and DR must satisfy the following condition:

$$0.85+(EL/100)\leqq DR\leqq 2.0+(EL/100)$$

wherein EL is the elongation (%) of the undrawn yarn.

A conventional poly(lactic acid) fiber for use in apparel has a draw ratio of less than or equal to [0.75+(EL/100)] (Comparative Example 3). Even a conventional poly(lactic acid) fiber for industrial use has a draw ratio of much lower than that in the poly(lactic acid) fiber of the present invention. For example, the draw ratio is less than or equal to [0.75+(EL/100)] at the first drawing stage in the process described in Japanese Unexamined Patent Application Publication No. 2000-248426.

In the process of the present invention, the poly(lactic acid) fiber is produced by drawing at a much higher draw ratio than in conventional equivalents, and the fiber structure of the material undrawn yarn is once destructed and reconstructed to yield a specific fiber structure to thereby improve the mechanical properties at high temperatures. In this connection, Japanese Unexamined Patent Application Publication No. 2001-226821 describes a spinning process in which a yarn is drawn and heat-treated in a heating tube in the spinning line. The draw ratio in this process can be estimated by determining a yarn speed profile with an on-line yarn speed meter along the spinning line and is found to be not higher than that in fibers for use in apparel, by taking a poly(ethylene terephthalate) fiber as an example. This spinning process cannot therefore produce the poly (lactic acid) fiber having satisfactory mechanical properties at high temperatures of the present invention. By setting the draw ratio DR less than or equal to [2.0+(EL/100)], the fiber can be prevented from excessive deformation to thereby avoid yarn breakage and unevenness of yarn significantly. The draw ratio DR should more preferably satisfy the following condition: $0.95+(EL/100)\leqq DR\leqq 1.5+(EL/100)$, and further preferably satisfy the following condition: $1.1+(EL/100)\leqq DR\leqq 1.4+(EL/100)$ In the process of the present invention, a second important factor is the orientation and crystallization of the undrawn yarn. The undrawn yarn for use in the present invention preferably is oriented and crystallized so as to have a crystalline size in the (200) plane of equal to or more than 6 nm. By this configuration, yarn breakage and uneven yarn can be prevented even when the undrawn yarn is drawn at such a high draw ratio as mentioned above. The crystalline size of the undrawn yarn is more preferably equal to or more than 7 nm, and further preferably equal to or more than 9 nm. In addition, the undrawn yarn preferably has a degree of orientation of equal to or more than 0.90. By this configuration, the molecular chain can stably be drawn from the crystalline to thereby enable the undrawn yarn to be drawn out stably even at a high draw ratio.

To yield such a crystallized undrawn yarn, poly(lactic acid) is preferably subjected to melt spinning at a spinning speed of equal to or more than 4000 m/min, and more preferably equal to or more than 5000 m/min.

The drawing temperature is preferably equal to or higher than 85° C., and more preferably equal to or higher than 130° C. At such a drawing temperature, the molecular chain can stably be drawn from the crystalline to thereby enable the undrawn yarn to be drawn stably even at a high draw ratio. In contrast, the drawing temperature is preferably lower than or equal to 160° C., since poly(lactic acid) has a melting point of around 170° C. under normal conditions. If an undrawn yarn which has not been oriented and crystallized is used, the undrawn yarn frequently becomes soft or spontaneously elongates on a preheat roller at a drawing temperature of equal to or higher than 130° C. to thereby cause instability of yarn running and yarn winding to a roller, and the process steps become unstable. By using the oriented and crystallized poly(lactic acid) fiber as the undrawn yarn, these problems can be solved.

The temperature of heat treatment is preferably equal to or higher than 120° C. and more preferably equal to or higher than 140° C. By treating at such a temperature, the resulting drawn yarn can have a stabilized fiber structure and have sufficient strength and a low boiling water shrinkage. In addition, such a high temperature heat treatment can stabilize drawing and heat treatment procedures to thereby prevent yarn breakage and uneven yarn. However, the heat treatment should preferably be performed at a temperature lower than or equal to 165° C., since poly(lactic acid) has a melting point around 170° C. under normal conditions.

When an undrawn yarn which has not sufficiently been oriented and crystallized, i.e., which has a crystalline size in the (200) plane of less than or equal to 6 nm is used, the drawing temperature plays a typically important role is preferably set at equal to or higher than 110° C. and more preferably equal to or higher than 130° C. By drawing at such a temperature, the undrawn yarn is oriented and sufficiently crystallized by preheating prior to drawing and can be drawn satisfactorily homogeneously, as in the oriented and crystallized undrawn yarn.

The term "undrawn yarn" as used herein means fibers that can be stably drawn under the aforementioned drawing conditions. Consequently, the undrawn yarn preferably has an elongation of equal to or more than 25%. For better productivity, the undrawn yarn is preferably a yarn which has not been subjected to other treatments after spinning. To prevent uneven yarn, the undrawn yarn preferably has U % of less than or equal to 1.5%.

The poly(lactic acid) fiber has a high coefficient of friction and is therefore susceptible to fluff during high-speed spinning process, yarn texturing process such as false-twist processing and yarn texturing with air, and fabric making processing such as beaming, weaving, and knitting. To prevent these problems, finishing oil is used. finishing oil mainly comprising polyether are not preferably used herein, and those mainly comprising lubricants such as fatty acid esters are preferred to decrease coefficient of friction of the poly(lactic acid) fiber and to prevent fluff during the above process steps significantly.

The aforementioned process for producing a poly(lactic acid) fiber has a very high production efficiency. This advantage will be described in detail below.

Japanese Unexamined Patent Application Publications No. 8-246247 and No. 2000-89938 mention that through-put per unit time during spinning can be used as one of indexes of production efficiency. Specifically, the larger the product of the spinning speed to yield a fiber with a desired degree of fineness is, the larger the through-put per unit time and production efficiency per unit time are. According to the process for producing a poly(lactic acid) fiber of the present invention, the undrawn yarn can be obtained at a higher spinning speed and can be drawn at a higher draw ratio than conventional processes and thereby has a very high production efficiency. For example, when an undrawn yarn spun at a spinning speed of 6000 m/min is used, the product of the spinning speed and the draw ratio is 10500 (Example 4), much higher than the product of the spinning speed and the draw ratio of 3600 in the conventional process (Comparative Example 3).

In addition, the process of the present invention can yield, even by single-stage drawing and heat treatment, a poly (lactic acid) fiber having a strength at 25° C. equivalent to conventional poly(lactic acid) fibers for industrial use produced by conventional multistage drawing and heat treatment. The process can thereby save the cost of equipment and energy consumption. The process can also be performed according to multistage drawing and heat treatment procedures according necessity, for example, for the production of an ultrahigh strength poly(lactic acid) fiber.

Some fibers each comprising a blend of an aromatic polyester and the poly(lactic acid) have markedly improved mechanical properties at high temperatures. This type of fibers will be described in detail below.

Aromatic polyesters for use in the present invention are polyesters each having an aromatic ring in its principle chain or side chain and include, for example, poly(ethylene terephthalate) (PET), poly(propylene terephthalate) (PPT), poly(butylene terephthalate) (PBT), and poly (hexamethylene terephthalate) (PHT).

However, homopoly(ethylene terephthalate) and homopoly(butylene terephthalate) have low compatibility (miscibility) with aliphatic polyesters and cannot substantially form polymer blends with such aliphatic polyesters including poly(lactic acid). To increase compatibility between an aromatic polyester and the poly(lactic acid), it is effective to introduce an aliphatic comonomer into the principle chain or side chain of the aromatic polyester to thereby increase affinity for poly(lactic acid). Alternatively, a bulky moiety is introduced into the principle chain or side chain of the aromatic polyester to decrease intercalation between the constitutive aromatic rings to thereby increase intervals or distances between the molecular chains. Preferred examples of the aliphatic comonomer are long alkyl chains such as alkylene diols and long-chain dicarboxylic acids, and preferred examples of the bulky moiety are bisphenol A derivatives. The alkylene diols include, but are not limited to, polyethylene glycol and other polymers and oligomers of alkylene oxides; and neopentyl glycol, hexamethylene glycol, and other diols each containing a large number of carbon atoms. The long-chain dicarboxylic acids include, but are not limited to, adipic acid and sebacic acid. The amount of the diol or the dicarboxylic acid component in copolymerization is preferably 2% to 15% by mole or 2% to 15% by weight relative to the total amount of carboxylic acids or to the total amount of diols, respectively. The resulting aromatic polyester comprising a copolymerized long alkyl chain or bulky component is hereinafter referred to as "specific aromatic polyester" for simplicity sake.

In addition, the specific aromatic polyester preferably further comprises isophthalic acid or another ingredient as a comonomer to lower its melting temperature, since the poly(lactic acid) has a melting point of around 170° C. and blending should preferably be performed at a lower temperature. The melting point of the specific aromatic polyester is preferably lower than or equal to 250° C., and more preferably lower than or equal to 230° C. In contrast, the melting point is preferably equal to or higher than 170° C., and more preferably equal to or higher than 200° C. in order to improve heat resistance of the resulting blend polyester comprising the poly(lactic acid) and the specific aromatic polyester (hereinafter briefly referred to as "blend polyester") and the molded article therefrom.

To improve stability of yarn producing and dimensional stability of the blend polyester, the blend polyester and the constitutive specific aromatic polyester are preferably crystalline. In this connection, when a melting peak of a polymer is observed in differential scanning calorimetry (DSC), the polymer can be determined as crystalline.

To yield sufficient biodegradability of the blend polyester, the amount of the specific aromatic polyester should preferably be less than or equal to 40% by weight relative to the total weight of the blend polyester. In contrast, to improve the mechanical properties at high temperatures, the amount of the specific aromatic polyester is preferably equal to or more than 5% by weight, and more preferably from 15% to 30% by weight.

The mechanical properties at high temperatures of the blend polyester according to the present invention can be improved. This is probably for the following reasons. A regular poly(lactic acid) has weak interaction between molecular chains, the constitutive molecular chains thereby pass through each other and thereby the poly(lactic acid) exhibits insufficient mechanical properties at high temperatures. In contrast, in the blend polyester, strong interaction between aromatic rings in the specific aromatic polyester serves to bind and support the poly(lactic acid) molecular chains firmly to thereby improve the mechanical properties at high temperatures of the resulting blend polyester fiber.

To further exhibit these advantages, high crystallinity or high $T_g$ (glass transition temperature) of the specific aromatic polyester is preferably utilized in the blend polyester, and the specific aromatic polyester and the poly(lactic acid) are preferably dissolved in each other to an appropriate extent.

A first embodiment of such a blend polyester in which the specific aromatic polyester and the poly(lactic acid) are dissolved in each other to an appropriate extent is a blend polyester of an island-in-sea structure. In this type of the blend polyester, the specific aromatic polyester and the poly(lactic acid) are phase-separated and constitute an island-in-sea structure in which fine islands each having a diameter of 0.001 to 1 $\mu$m are dispersed.

A second embodiment is a blend polyester of a bicontinuous structure as a result of spinodal decomposition. The spinodal decomposition is a process in which different types of polymers are once completely dissolved with each other and are then phase-separated. The resulting blend is of the co-continuous structure in which sea and islands cannot significantly be distinguished. The bicontinuous structure has an intensity peak (intensity maximum) in Fourier transformation pattern analysis, i.e., has a periodical structure. The second embodiment herein having the co-continuous structure has higher compatibility than that of the first embodiment having the island-in-sea structure.

The blend polyester fibers of the present invention have a special structure under some conditions.

Specifically, in a blend polyester fiber having such a special structure, the poly(lactic acid) enters domains of the specific aromatic polyester to some extent. In the resulting blend polyester fiber, the specific aromatic polyester firmly bind the poly(lactic acid). Such a special blend structure can be identified, for example, in the following manner. The blend polyester fiber is observed with a transmission electron microscope (TEM), and the ratio of dark portions(PET) to bright portions(PLA) is determined based on the observed image and is compared with the charging amount of the poly(lactic acid) to the specific aromatic polyester. Alternatively, this structure can be identified based on determination of a long period in small angle X-ray scattering analysis.

Figure 8:
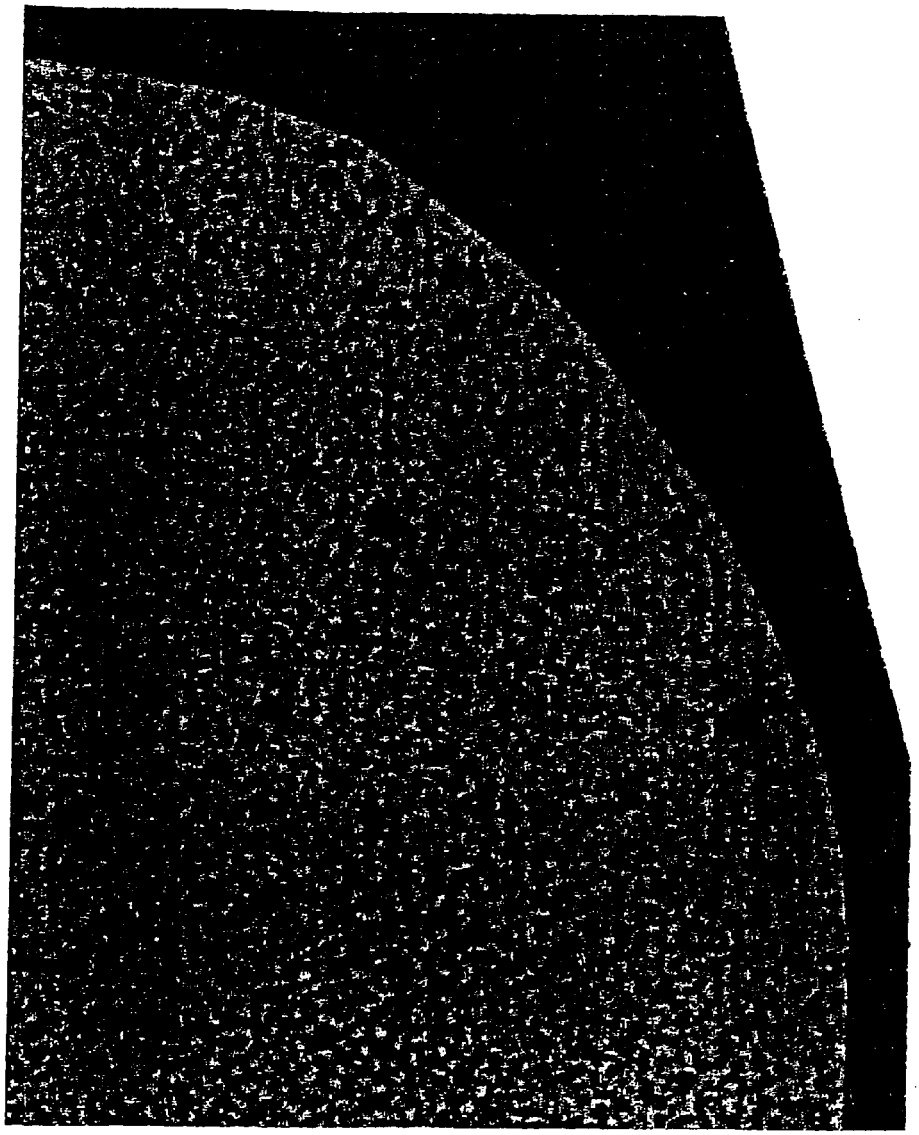
FIG. 8 is a transmission electron microscopic image showing the state of blend in a fiber according to Example 10.

For example, TEM observation (FIG. 8) of a blend polyester fiber comprising 80% by weight of poly(lactic acid) and 20% by weight of a copoly(ethylene terephthalate) shown in Example 10 shows that the ratio of bright portions to dark portions is 45:55 (% by area). In contrast, a predicted ratio of the bright portions to the dark portions based on the charging ratio is 81:19 (% by area). By comparing these two ratios, it is understood that the ratio of the dark portions in the actual blend polyester fiber is higher than the predicted value, indicating that the poly(lactic acid) enters into the domains of the copoly(ethylene terephthalate). In addition, the copoly(ethylene terephthalate) has a long period of about 10 nm under normal conditions, but the blend polyester fiber in Example 10 has an approximately doubled long period of 19 nm. The result indicates that the molecular chains of the copoly(ethylene terephthalate) partially sandwich the molecular chains of the poly(lactic acid).

If the specific aromatic polyester and the poly(lactic acid) are completely dissolved with each other at a molecular level, the resulting blend polyester has good spinability but may not exhibit sufficient crystallinity of the two components or may have insufficiently increased $T_g$ due to additive property of $T_g$ in some cases. In these cases, the specific aromatic polyester does not effectively bind the poly(lactic acid) moiety, and the resulting blend polyester fiber may not have sufficiently improved mechanical properties at high temperatures.

In contrast, if the specific aromatic polyester and the poly(lactic acid) have excessively low compatibility with each other, the poly(lactic acid) cannot enter the domain of the aromatic polyester to thereby fail to exhibit the above advantages and improved mechanical properties at high temperatures. In addition, such an immiscible system frequently behaves elastically due to phase separation and the resulting blend polyester has markedly deteriorated spinability. The poly(lactic acid) and a homopoly(ethylene terephthalate) or a homopoly(butylene terephthalate) constitute the immiscible system and cannot substantially form a polymer blend.

The poly(lactic acid) fiber of the present invention may be whichever of a flat yarn or a crimped yarn. Such a crimped yarn can be produced, for example, by the following first and second processes.

In the first process, the poly(lactic acid) fiber having excellent mechanical properties at high temperatures is converted into a yarn and is then crimped.

In the second process, the poly(lactic acid) fiber having a crystalline size in the (200) plane of equal to or more than 6 nm and obtained by spinning at a high speed or the blend polyester fiber comprising the aromatic polyester and the poly(lactic acid) is directly subjected to crimping. Such crimping operations include, for example, draw false-twist texturing, mechanical crimping, and indenting using an air-jet nozzle. In draw false-twist texturing, a heater temperature is preferably set at equal to or higher than 130° C. to yield a crimped yarn having high crimping properties and a low shrinkage. By using a second heater according to necessity, the crimped yarn can become further resistant to shrinkage.

The poly(lactic acid) crimped yarn having satisfactory mechanical properties at high temperatures has a crimp rigidity CR of preferably equal to or more than 10%, more preferably equal to or more than 15%, and further preferably equal to or more than 20%. The crimp rigidity CR is an index of crimp properties.

The poly(lactic acid) fiber of the present invention can have a cross section of any form such as round, hollow, trefoil, polyfoil, and other modified cross sections. The fiber is not specifically limited in its shape and may be, for example, a staple fiber or a filament such as a multifilament and a monofilament. Specifically, the fiber is preferably a multifilament for wide-range applicability.

The poly(lactic acid) fiber of the present invention can be formed into various fibrous articles such as woven fabrics, knitted fabrics, and non-woven fabrics, as well as cups and other molded articles.

The poly(lactic acid) fiber can be advantageously used as material yarns for crimping such as false-twist processing and in apparels such as shirts, jumpers and pants, as well as apparel materials such as cups and pads; interiors such as curtains, carpets, mats and furniture; interior automotive trims; materials for industrial use such as belts, nets, ropes, canvas, bags and sacks, and threads; felts; nonwoven fabrics; filters; artificial lawn; and other applications.

The poly(lactic acid) fibers having novel structures of the present invention have significantly improved mechanical properties at high temperatures, can thereby solve problems in durability during weaving process step or during use in a high-temperature atmosphere and can extend the boundaries in applications of poly(lactic acid) fibers.

EXAMPLES

The present invention will be illustrated in further detail with reference to several examples and comparative examples below, which are not intended to limit the scope of the invention. The physical properties in the following examples and comparative examples were measured according to the following methods.

A. Weight Average Molecular Weight of Poly(lactic acid)

A solution of a sample in chloroform was mixed with tetrahydrofuran (THF) and thereby yielded a test solution. The weight average molecular weight in terms of polystyrene of the sample in the test solution was determined at 25° C. with a gel permeation chromatograph (GPC) Waters 2690 available from Waters Corporation, Mass.

B. Tensile Strength and Elongation at Break at 25° C.

According to JIS L 1013 (Test Methods for Man-Made Filament Yarns), a load-elongation curve was obtained at 25° C. at an initial sample length of 200 mm at a tensile speed of 200 mm/min. Then, the load was divided by the initial degree of fineness of the fiber, to be expressed as the strength, and the elongation was divided by the initial sample length, to be expressed as the elongation. The strength was plotted versus the elongation to yield a strength-elongation curve.

C. Strength at 90° C.

A strength-elongation curve was obtained in the same manner as in "B. Tensile strength and elongation at break at 25° C.", except that the measurement was performed at 90° C. The strength at 90° C. was determined by dividing the load at break by the initial degree of fineness and was then plotted versus elongation to yield a strength-elongation curve.

D. Creep Rate at 90° C.

The creep rate at 90° C. was determined by reading the elongation at a stress of 0.7 cN/dtex in the strength-elongation curve at 90° C. obtained above.

E. Boiling Water Shrinkage

From the yarn package, a hank was taken using a counter wheel, and the hank length L0 measured with a length measurement load of 0.09 cN/dtex applied. Then this length measurement load was removed and the hank introduced into boiling water for 15 minutes substantially under no load, after which it was removed, air dried, the length measurement load again applied and hank length L1 was measured. The boiling water shrinkage was determined according to the following equation:

$$\text{Boiling water shrinkage } (\%)=[(L0-L1)/L0]\times 100$$

F. Uster Unevenness (U %)

The Uster unevenness (U %) was determined using an USTER TESTER 4 available from Zellweger Uster at a yarn supply of 200 m/min, and the mean deviation (U %) was determined in normal mode.

G. Solid-state $^{13}$C-NMR

A $^{13}$C CP/MAS NMR spectrum was determined under the following conditions using a CMX-300 Infinity NMR spectrometer available from Chemagnetics, Varian, Inc. to thereby analyze the carbonyl carbon moiety of ester bond. Observed peaks were subjected to peak resolution by curve fitting into a peak in the vicinity of 170.2 ppm belonging to the $10_3$ helical structure and a peak in the vicinity of 171.6 ppm belonging to the $3_1$ helical structure. The ratio ($3_1$ ratio) of the integrated intensity of the peak in the vicinity of 171.6 ppm to the total integrated intensity of peaks observed at 165 ppm to 175 ppm was determined.

Instrument: CMX-300 Infinity NMR spectrometer available from Chemagnetics, Varian, Inc.

Measuring temperature: room temperature

Reference substance: silicone rubber (internal reference: 1.56 ppm)

Measured nucleus: 75.1910 MHz

Pulse width: 4.0 μsec

Pulse repetition time: ACQTM (acquisition time)= 0.06826 sec, PD (pulse delay)=5 sec Data point: POINT=8192, SAMPO=2048

Spectrum width: 30.003 kHz

Pulse mode: relaxation time determination mode

Contact time: 5000 μsec

H. Wide Angle X-ray Diffraction Pattern

A wide angle X-ray diffraction plate image was obtained using an X-ray diffractometer Model 4036 A2 available from Rigaku Corporation under the following conditions:

X-ray source: Cu—Kα line (with a Ni filter)

Output: 40 kV×20 mA

Slit: pinhole collimator 1 mm in diameter

Camera radius: 40 mm

Exposure time: 8 min

Film: Kodak DEF-5

I. Crystalline Size

The diffraction intensity in the equatorial direction of a sample was determined using an X-ray diffractometer Model 4036 A2 available from Rigaku Corporation under the following conditions:

X-ray source: Cu—Kα line (with a Ni filter)

Output: 40 kV×20 mA

Slit: 2 mmΦ−1°−1°

Detector: scintillation counter

Counter-recorder: Model RAD-C available from Rigaku Corporation

Step scanning: 0.05° step

Integration time: 2 seconds

The crystalline size in the (200) plane L was calculated according to the Scherrer's Formula:

$$L=K\lambda/(\beta_0\cos\theta_B)$$

wherein L is the crystalline size (nm); K is a constant of 1.0; λ is the wavelength of X-ray of 0.15418 nm; $\theta_B$ is the Bragg angle; and $\beta_0$ is represented by $(\beta_E^2-B_1^2)^{1/2}$, wherein $\beta_E$ is the apparent half-width (measured value) ; and $\beta_1$ is the constant specific to the instrument of $1.046\times10^{-2}$ rad.

J. Crystalline Orientation

The crystalline orientation in the (200) plane was determined in the following manner.

A peak corresponding to the (200) plane was scanned in the circumferential direction to yield an intensity distribution, and the crystalline orientation was calculated from the half width obtained in the intensity distribution according to the following equation:

$$\text{Crystalline orientation } (\pi)=(180-H)/180$$

wherein H is the half width (deg.).

Measuring range: 0° to 180°

Step scanning: 0.5° step

Integration time: 2 seconds

K. Crimp Rigidity CR of False-twisted Yarn

A false-twisted yarn was wound on a spool to make a skein, was allowed to freely shrink in boiling water under substantially no load for 15 minutes and was air-dried for 24 hours. The resulting sample was immersed in water under a load equivalent to 0.088 cN/dtex (0.1 gf/d), and the skein length L'0 was determined 2 minutes later. The skein equivalent to 0.088 cN/dtex was removed in water, the load was then replaced with a light load equivalent to 0.0018 cN/dtex (2 mgf/d), and the skein length L'1 was determined 2 minutes later. Based on these measurements, the crimp rigidity CR was calculated according to the following equation:

$$CR\ (\%)=[(L'0-L'1)/L'0]\times100$$

Examples 1 and 2

Figure 9:
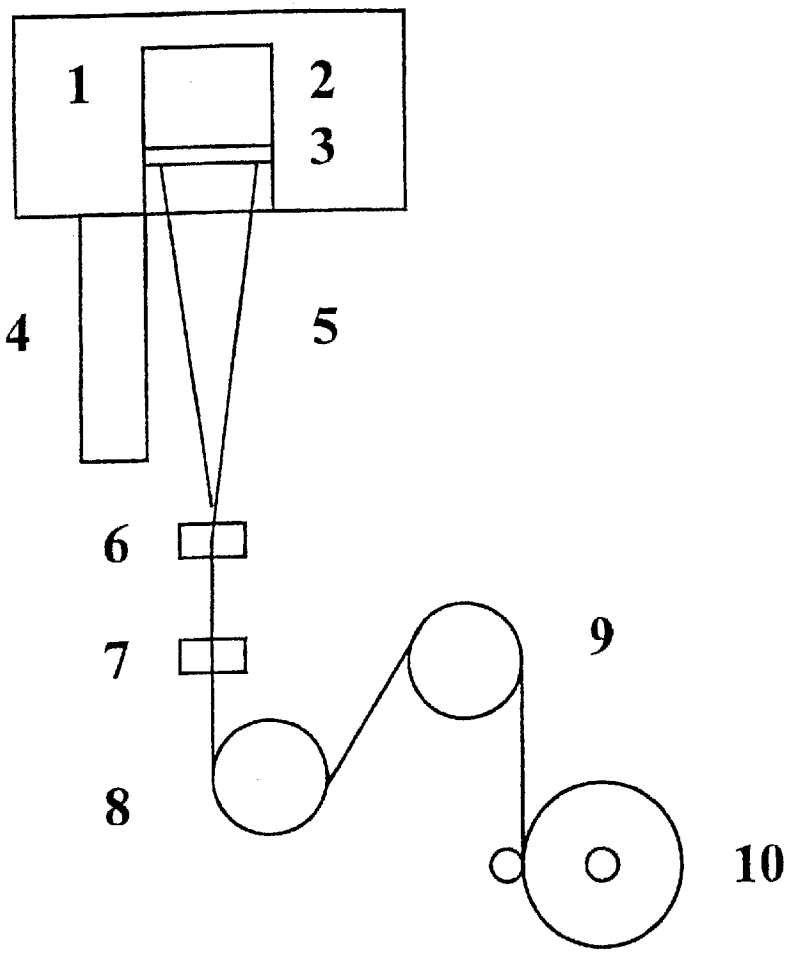
FIG. 9 schematically illustrates a spinning machine used in Examples 1 to 12 and 19 to 21 and Comparative Examples 2, 3, 8 to 14 and 17.

A poly(L-lactic acid) having a weight average molecular weight of 190000 and an optical purity as L-lactic acid of 99% was dried, was subjected to melt spinning at 240° C., the resulting yarn was cooled and solidified with a cooling air at 25° C. using a chimney 4. Finishing oil mainly containing aliphatic esters was applied to the solidified yarn using a bundling-oiling guide 6, and the yarn was then entangled with an interlacing guide 7 (FIG. 9). The resulting undrawn yarn 10 was then reeled with an unheated first take-up roller 8 at a peripheral speed of 5000 m/min., i.e., a spinning speed of 5000 m/min. and was then reeled via an unheated second take-up roller 9. The reeled homopoly(L-lactic acid) undrawn yarn had a crystalline size in the (200) plane of 7.7 nm, a crystalline orientation of 0.96, U % of 0.8%, and an elongation at 25° C. of 50%. The undrawn yarn 10 was drawn and heat-treated using the apparatus shown in FIG. 10 under the conditions indicated in Table 1 and thereby yielded 84 dtex-24 filament drawn yarns each having a round cross section.

Figure 2:
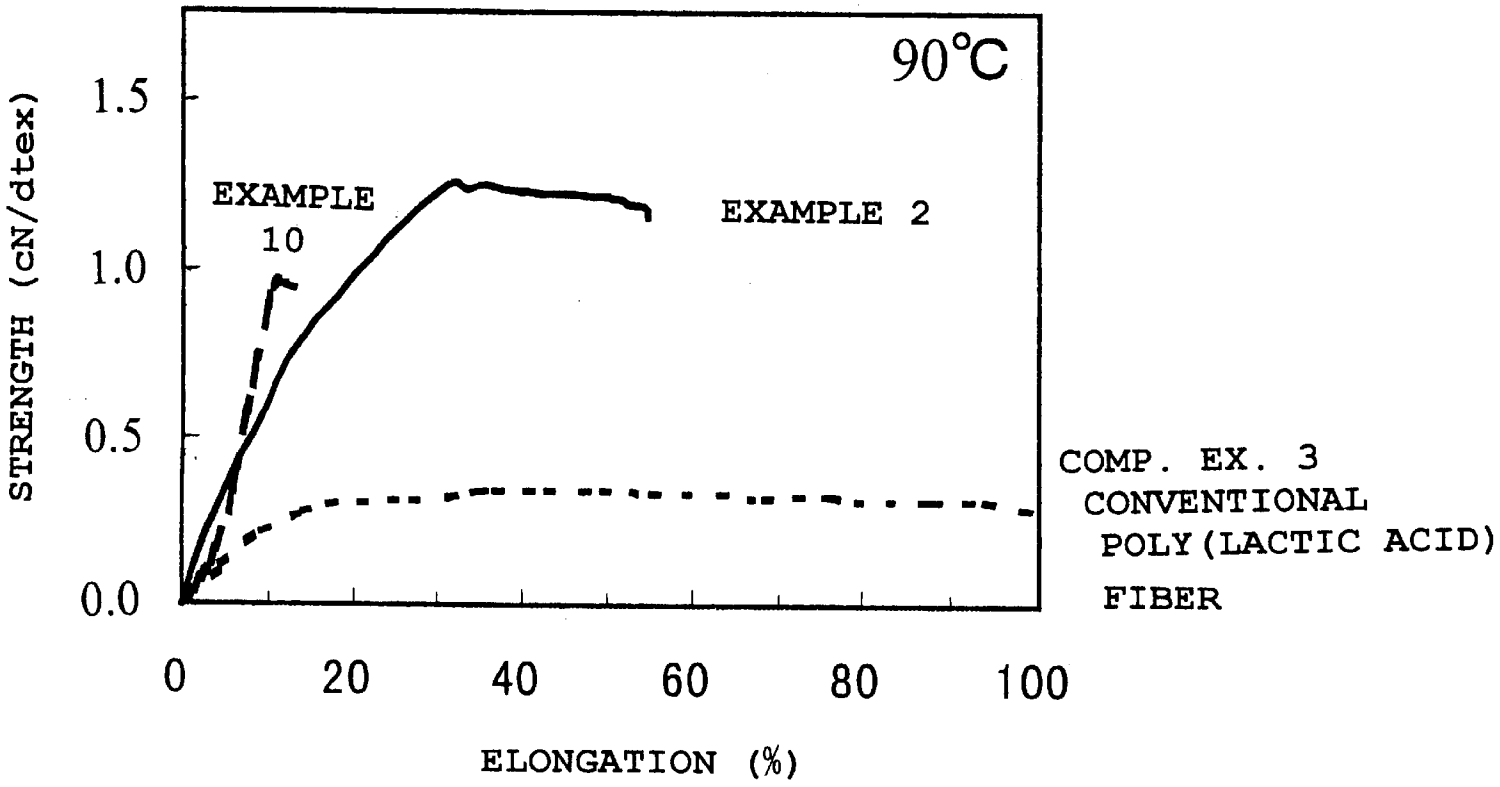
FIG. 2 illustrates plots of strength versus elongation at 90° C. on Examples 2 and 10 and Combative Example 3 (a conventional poly(lactic acid) fiber)
Figure 3:
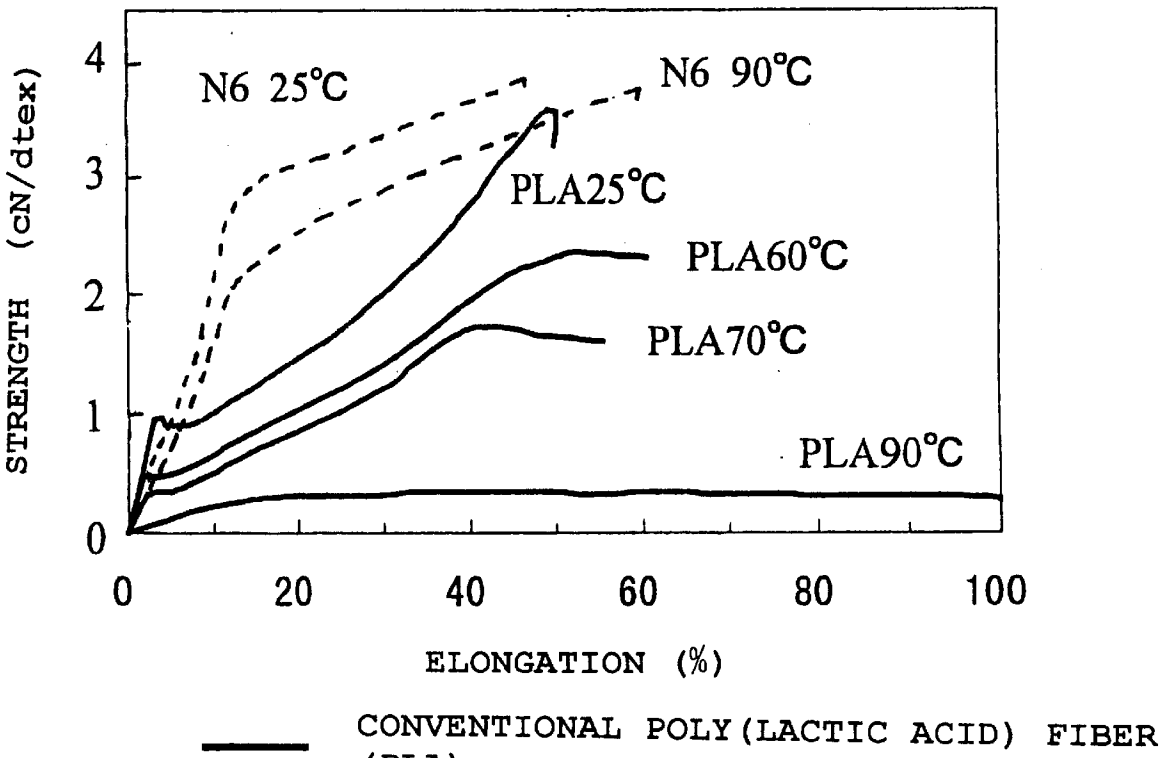
FIG. 3 illustrates plots of strength versus elongation on the conventional poly(lactic acid) fiber (Comparative Example 3) and a nylon 6 fiber.
Figure 6:
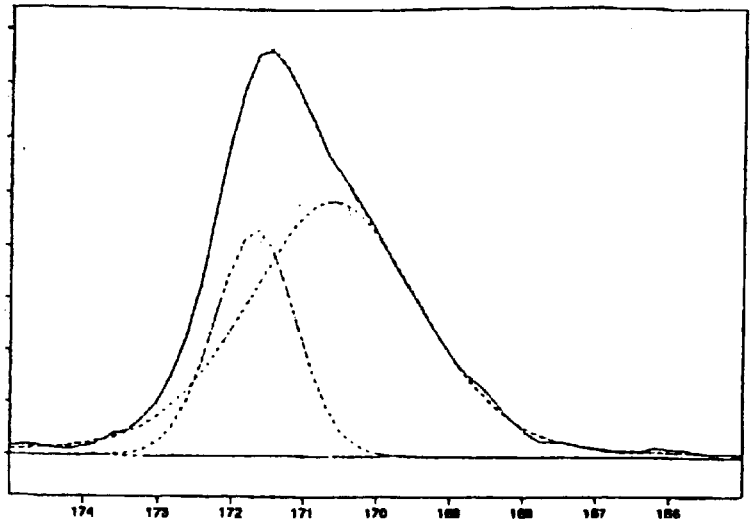
FIG. 6 illustrates peak resolution of the solid state NMR spectra.
Figure 6:
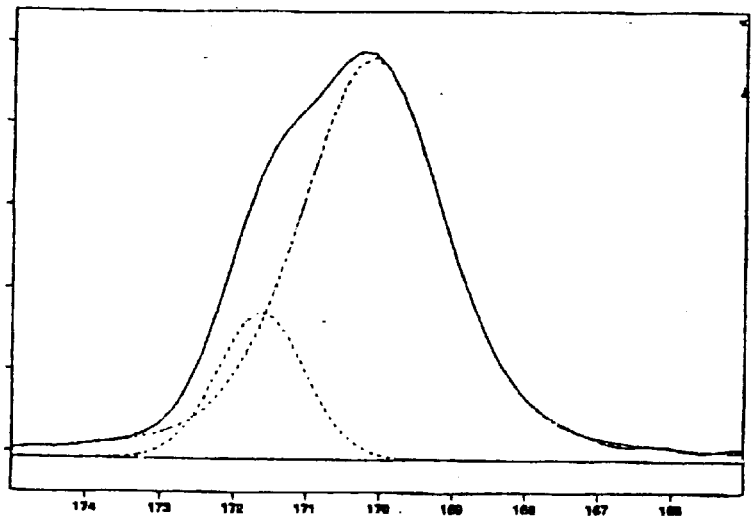

FIG. 5 illustrates solid-state NMR spectra of these drawn yarns. A clear peak in the vicinity of 171.6 ppm belonging to the $3_1$ helical structure was observed in the fiber according to Example 1, and a shoulder peak corresponding thereto was observed in the fiber according to Example 2. These spectra were subjected to peak resolution, and the ratios of the integrated intensity of the peak in the vicinity of 171.6 ppm ($3_1$ ratios) were determined to find that the $3_1$ ratios were 29% and 17% in Examples 1 and 2, respectively (FIG. 6). The fibers were subjected to wide angle X-ray diffractometry (WAXD). The fiber of Example 1 was found to show a pattern analogous to the beta crystal described in Macromolecules, vol. 23, 642 (1990), showing that a crystalline having the $3_1$ helical structure was produced (FIG. 7). In contrast, the fiber of Example 2 did not show a pattern of a crystalline having the $3_1$ helical structure. The strength-elongation curve at 90° C. and the physical properties of the fiber of Example 1 are shown in FIG. 1 and Table 1, respectively. These results demonstrate that the fiber of Example 1 have markedly improved mechanical properties at 90° C. as compared with a conventional high-strength poly(lactic acid) fiber (Comparative Example 1). The strength-elongation curve at 90° C. and the physical properties of the fiber of Example 2 are shown in FIG. 2 and Table 1, respectively. These results demonstrate that the fiber of Example 2 have markedly improved mechanical properties at 90° C. as compared with a conventional poly(lactic acid) fiber (Comparative Example 3). The fiber of Example 2 had an elongation of 8% at 90° C. at a stress of 0.5 cN/dtex.

Examples 3 and 4

The spinning and drawing procedures of Example 1 were repeated except that the spinning speed was changed to 6000 m/min and thereby yielded 84 dtex-96 filament drawn yarns. An undrawn yarn prepared herein had a crystalline size in the (200) plane of 9.2 nm, a crystalline orientation of 0.96, U % of 0.8%, and an elongation at 25° C. of 43%.

The solid-state NMR spectra of the drawn yarns demonstrate that they have the $3_1$ helical structure. Table 1 shows the physical properties of these drawn yarns and demonstrates that they have significantly improved mechanical properties at 90° C. as compared with the conventional high-strength poly(lactic acid) fiber (Comparative Example 1).

Example 5

The spinning and drawing procedures of Example 1 were repeated except that the peripheral speed of the first take-up roller 8, the temperature of the first hot roller 12 in drawing process, and the draw ratio were changed to 4000 m/min, 110° C., and 1.6, respectively, and thereby yielded a 84 dtex-36 filament homopoly(L-lactic acid) drawn yarn having trefoil cross section. A reeled yarn after spinning herein had a crystalline size in the (200) plane of 6.8 nm, a crystalline orientation of 0.91, U % of 0.8%, and an elongation at 25° C. of 72%. The solid-state NMR spectrum of resulting drawn yarn demonstrates that it has the $3_1$ helical structure. Table 1 shows the physical properties of the drawn yarn and demonstrates that it has improved mechanical properties at 90° C. as compared with the conventional high-strength poly(lactic acid) fiber (Comparative Example 1). The fiber of Example 5 had an elongation of 12% at 90° C. at a stress of 0.5 cN/dtex.

Example 6

The spinning and drawing procedures of Example 1 were repeated except that the peripheral speed of the first take-up roller 8, the temperature of the first hot roller 12 in drawing process, and the draw ratio were changed to 3000 m/min, 140° C., and 2.05, respectively, and thereby yielded a 84 dtex-24 filament homopoly(L-lactic acid) drawn yarn having a round cross section. An undrawn yarn prepared herein did not exhibit a crystalline pattern in WAXD, indicating that it was non-crystalline. The undrawn yarn had U % of 1.1% and an elongation at 25° C. of 95%. The yarn therefore showed some degree of instability of yarn running on the first hot roller but it was trivial.

The solid-state NMR spectrum of resulting drawn yarn demonstrates that it has the $3_1$ helical structure. Table 1 shows the physical properties of the drawn yarn and demonstrates that it has improved mechanical properties at 90° C. as compared with the conventional high-strength poly (lactic acid) fiber (Comparative Example 1).

Comparative Example 1

A poly(L-lactic acid) having a weight average molecular weight of 150000 and an optical purity as L-lactic acid of 99% was subjected to three-stage drawing and heat treatment according to the process described in Example 9 of Japanese Unexamined Patent Application Publication No. 2000-248426 and thereby yielded a high strength poly(lactic acid) fiber. The conditions in this procedure are as follows: spinning speed of undrawn yarn of 2200 m/min, drawing temperature at first stage of 82° C., drawing temperature at second stage of 130° C., drawing temperature at third stage of 160° C., draw ratio at the first stage of 1.53, draw ratio at the second stage of 1.55, draw ratio at the third stage of 1.55, and final heating temperature of 155° C.

The solid-state NMR spectrum of the resulting drawn yarn did not exhibit a peak in the vicinity of 171.6 ppm corresponding to the $3_1$ helical structure (FIG. 5). The drawn yarn was then subjected to wide angle X-ray diffractometry but only yielded a pattern corresponding to the regular alpha crystal ($10_3$ helical structure), although it was found to be highly crystallized. Table 1 shows the physical property of the drawn yarn and demonstrates that it has insufficient mechanical properties at 90° C. although it has high strength at room temperature.

Comparative Examples 2 and 3

Poly(lactic acid) undrawn yarns were obtained in the same manner as in Example 1, except employing the spinning speeds indicated in Table 1. The undrawn yarns were non-crystalline and their crystalline sizes could not be determined. The undrawn yarns obtained at a spinning speed of 400 m/min (Comparative Example 2) and at a spinning speed of 1500 m/min (Comparative Example 3) had U % of 1.7% and 1.3%, respectively. These undrawn yarns were subjected to drawing and heat treatment in the same manner as in Example 1 under the conditions shown in Table 1 and thereby yielded 84 dtex-24 filament drawn yarns each having a round cross section.

The solid-state NMR spectra of the resulting drawn yarns did not exhibit a peak in the vicinity of 171.6 ppm corresponding to the $3_1$ helical structure. The drawn yarns were then subjected to wide angle X-ray diffractometry but only yielded a pattern corresponding to the regular alpha crystal ($10_3$ helical structure), although they were found to be highly crystallized. Table 1 shows the physical property of the drawn yarns and demonstrates that they have insufficient mechanical properties at 90° C. although they have high strength at room temperature.

Comparative Example 4

The properties of the undrawn yarn obtained in Example 1 at a spinning speed of 5000 m/min without drawing and heat treatment were determined. The solid-state NMR spectrum of the undrawn yarn did not exhibit a peak in the vicinity of 171.6 ppm corresponding to the $3_1$ helical structure. The undrawn yarn was then subjected to wide angle X-ray diffractometry but only yielded a pattern corresponding to the regular alpha crystal ($10_3$ helical structure), although it was found to be highly crystallized. Table 1 shows the physical property of the undrawn yarn and demonstrates that it has insufficient mechanical properties at 90° C.

TABLE 1

Comparative Example 5

Figure 12:
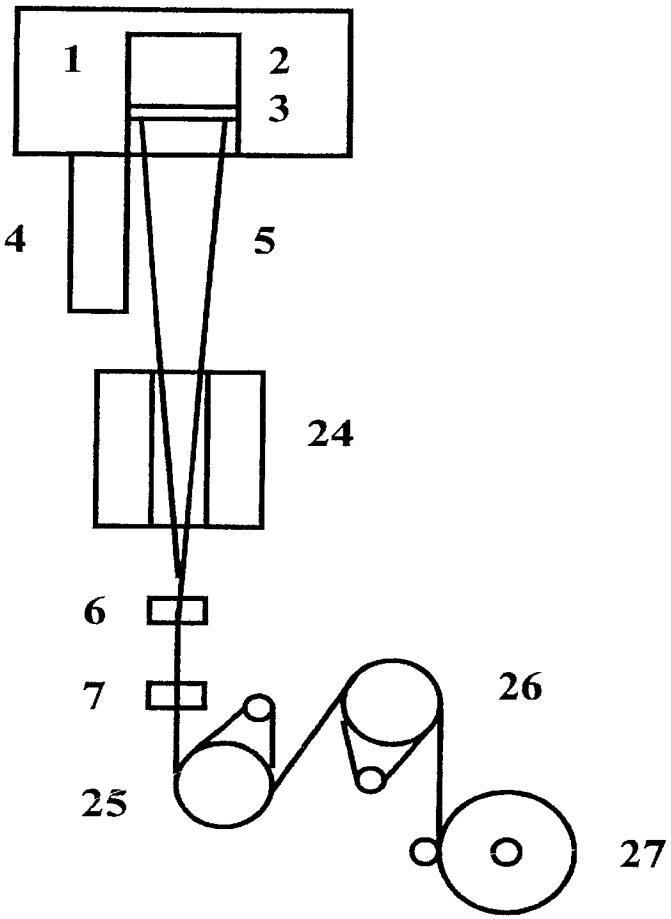
FIG. 12 schematically illustrates a spinning machine used in Comparative Examples 5 and 6.

A poly(L-lactic acid) having a weight average molecular weight of 140000 and an optical purity as L-lactic acid of 99% was dried, was then subjected to melt spinning at 210° C. using the apparatus shown in FIG. 12, the resulting yarn was cooled and solidified with a cooling air at 15° C. using the chimney 4. The yarn was then passed through a tubular heater 24 at an inner wall temperature of 150° C. having an effective heating length of 130 cm and was left stand to cooling. Finishing oil was then applied to the yarn using the bundling-oiling guide 6, and the yarn was entangled by the interlacing guide 7. The resulting yarn 10 was then taken up with the unheated first take-up roller 25 at a peripheral speed of 4500 m/min and was then reeled at a speed of 4470 m/min via the second take-up roller 26 at 110° C. at a peripheral speed of 4550 m/min and thereby yielded a 84 dtex-36 filament yarn 27 having a round cross section. The resulting yarn has low strength at 90° C. of 0.5 cN/dtex although it has a high strength at 25° C. of 4.5 cN/dtex.

Comparative Example 6

A 84 dtex-36 filament yarn 27 having a round cross section was obtained by the spinning procedure of Comparative Example 5, except that the tubular heater 24 was not used, that the yarn was reeled at a speed of 4490 m/min. via the first take-up roller 25 at a peripheral speed of 3500 m/min and via the second take-up roller 26 at a peripheral speed of 4550 m/min. Table 1 shows the physical properties of the resulting yarn and demonstrates that it has a significantly low strength at 90° C. of 0.3 cN/dtex.

Comparative Example 7

Figure 13:
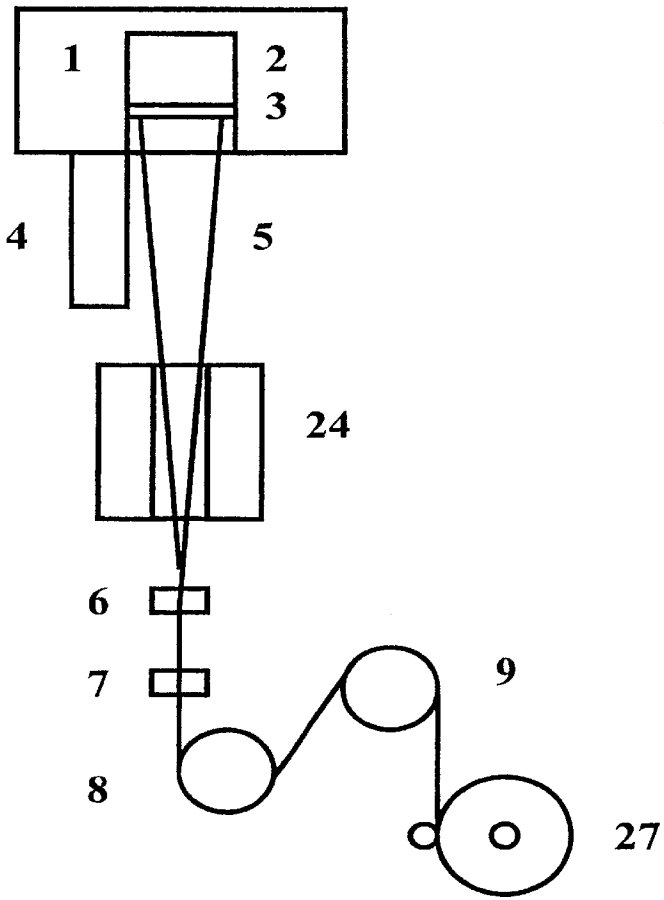
FIG. 13 schematically illustrates a spinning machine used in Comparative Example 7.

A poly(L-lactic acid) having a weight average molecular weight of 140000 and an optical purity as L-lactic acid of 99% was dried and was kneaded with 2.5% by weight of silica having an average grain size of 0.045 $\mu$m in a twin-screw extruder. The resulting polymer was dried and was subjected to melt spinning using an apparatus shown in FIG. 13. Specifically, the polymer was melted at 250° C. and was spun at a single-orifice through-put of 1.39 g/min. from a die orifice 0.25 mm in diameter, the resulting yarn was cooled and solidified with a cooling air at 15° C. using the chimney 4. The yarn was then passed through the tubular heater 24 at an inner wall temperature of 200° C. and was left stand to cool. The tubular heater 24 was arranged 1.2 m beneath the die and had a length of 1.0 m, an inlet diameter of 8 mm, and an inner diameter of 30 mm. Finishing oil was then applied to the yarn using the bundling-oiling guide 6, and the yarn was entangled by the interlacing guide 7. The resulting yarn was taken up with an unheated first take-up roller 8 at a peripheral speed of 4000 m/min., was reeled via a second take-up roller 9 and thereby yielded a 84 dtex-24 filament yarn 10 having a round cross section. The resulting yarn has low strength at 90° C. of 0.5 cN/dtex.

Example 7

The spinning and drawing procedures of Example 1 were repeated, except that a poly(L-lactic acid) having a weight average molecular weight of 140000 and an optical purity as L-lactic acid of 99% was subjected to melt spinning at 220° C., and thereby yielded a 84 dtex-24 filament drawn yarn having a hollow round cross section (hollowness percentage: 15%). An undrawn yarn prepared herein had a crystalline size in the (200) plane of 7.7 nm, a crystalline orientation of 0.96, U % of 1.2%, and an elongation at 25° C. of 47%. The solid-state spectrum of the drawn yarn demonstrates that it has the $3_1$ helical structure. Table 2 shows the physical properties of the drawn yarn and demonstrates that it has significantly improved mechanical properties at 90° C. as compared with the conventional high-strength poly(lactic acid) fiber (Comparative Example 1). The fiber of Example 7 has an elongation of 10% at 90° C. under a stress of 0.5 cN/dtex.

Example 8

A poly(L-lactic acid) having a weight average molecular weight of 140000 and an optical purity as L-lactic acid of 99% was dried and was subjected to melt spinning at 220° C. in the same manner as in Example 1 and thereby yielded an undrawn yarn. The undrawn yarn had a crystalline size in the (200) plane of 7.7 nm, a crystalline orientation of 0.94, U % of 1.0%, and an elongation at 25° C. of 49%. The undrawn yarn was then subjected to drawing and heat treatment in a similar manner to that in Example 1 under the condition indicated in Table 2 and thereby yielded a 84 dtex-36 filament drawn yarn having a trefoil cross section.

The solid-state NMR spectrum of the drawn yarn shows that it has the $3_1$ helical structure. Table 2 shows the physical properties of the drawn yarn and demonstrates that it has significantly improved mechanical properties at 90° C. as compared with the conventional high-strength poly(lactic acid) fiber (Comparative Example 1).

Example 9

The melt spinning, drawing and heat treatment procedures of Example 8 were repeated under the condition indicated in Table 2 and thereby yielded a 84 dtex-36 filament drawn yarn having a hollow cross section (hollowness percentage: 20%). An undrawn yarn prepared herein had a crystalline size in the (200) plane of 7.6 nm, a crystalline orientation of 0.94, U % of 1.2%, and an elongation at 25° C. of 46%.

The solid-state NMR spectrum of the drawn yarn shows that it has the $3_1$ helical structure. Table 2 shows the physical properties of the drawn yarn and demonstrates that it has significantly improved mechanical properties at 90° C. as compared with the conventional high-strength poly(lactic acid) fiber (Comparative Example 1).

TABLE 2

Example 10

Figure 10:
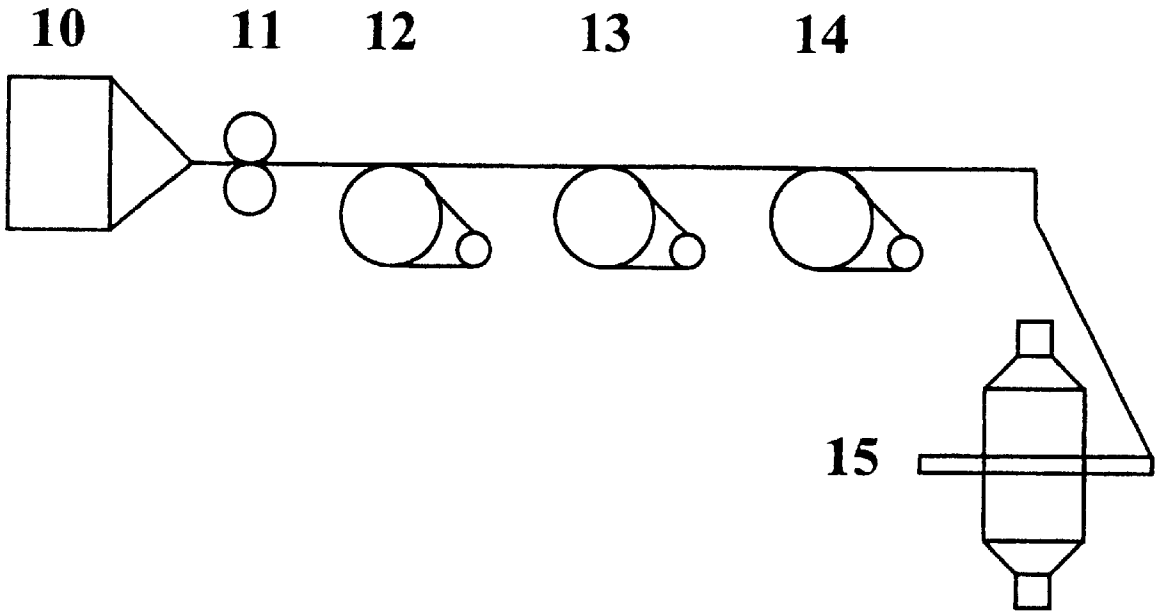
FIG. 10 is schematically illustrates a drawing machine used in Examples 1 to 12 and 19 to 21 and Comparative Examples 2, 3, and 8 to 14.

A copoly(ethylene terephthalate) having an intrinsic viscosity of 0.65 and a melting point of 220° C. was prepared by copolymerization with 6% by mole of a bisphenol A-ethylene oxide adduct as an alkylene oxide and 6% by mole of isophthalic acid. The poly(lactic acid) used in Example 7 was dried and was melted and blended with the copoly(ethylene terephthalate) at 235° C. in a twin-screw extruder and thereby yielded blend polymer chips. The amount of the copoly(ethylene terephthalate) was 20% by weight based on the weight of the resulting blend polymer. The blend polymer chips had $T_g$ of 61° C., nearly equivalent to that of a homopoly(L-lactic acid), i.e., 60° C. The blend polymer chips were dried, were subjected to melt spinning at a spinning temperature of 235° C., the resulting yarn was cooled and solidified with a cooling air at 25° C. using the chimney 4. Finishing oil was then applied to the yarn using the bundling-oiling guide 6, and the yarn was entangled by the interlacing guide 7 (FIG. 9). The resulting yarn was taken up with the unheated first take-up roller 8 at a peripheral speed of 1500 m/min and was then reeled via the unheated second take-up roller 9. The reeled yarn was pre-heated with a first hot roller 12 at a temperature of 90° C., was drawn at a draw ratio of 2.8, was heat-set with a second hot roller 13 at 130° C., was reeled by an unheated third roller 14 and thereby yielded a 84 dtex-36 filament drawn yarn 15 having a round cross section (FIG. 10). The strength-elongation curve at 90° C. and the physical properties of the drawn yarn are shown in FIG. 2 and Table 3, respectively. These results demonstrate that the drawn yarn of Example 10 has a higher yield stress and significantly improved mechanical properties at 90° C. as compared with the conventional poly(lactic acid) fiber (Comparative Example 3). The wide angle X-ray diffractometry of the drawn yarn shows that the copoly(ethylene terephthalate) constitutes an oriented crystalline. The drawn yarn had an elongation of 7% at 90° C. under a stress of 0.5 cN/dtex.

Example 11

A copoly(ethylene terephthalate) having an intrinsic viscosity of 0.55 and a melting point of 240° C. was prepared by copolymerization with 4% by mole of polyethylene glycol having a molecular weight of 1000 and 6% by mole of isophthalic acid. The prepared copoly(ethylene terephthalate) and the dried poly(lactic acid) used in Example 1 were melted and blended at 250° C. in a twin-screw extruder and thereby yielded blend polymer chips. The amount of the copoly(ethylene terephthalate) was 20% by weight based on the weight of the resulting blend polymer. The blend polymer chips were dried and were spun and drawn in the same manner as in Example 10, except that the spinning temperature was changed to 250° C., and thereby yielded a 164 dtex-48 filament drawn yarn having a round cross section. Table 3 shows the physical properties of the drawn yarn and demonstrates that it has markedly improved mechanical properties at 90° C. as compared with the conventional poly(lactic acid) fiber (Comparative Example 3). The drawn yarn had an elongation of 5% at 90° C. under a stress of 0.5 cN/dtex.

Example 12

A copoly(ethylene terephthalate) having an intrinsic viscosity of 0.65 and a melting point of 225° C. was prepared by copolymerization with 10% by mole of adipic acid and 6% by mole of isophthalic acid. The prepared copoly (ethylene terephthalate) and the dried poly(lactic acid) used in Example 1 were melted and blended at 235° C. in a twin-screw extruder and thereby yielded blend polymer chips. The amount of the copoly(ethylene terephthalate) was 20% by weight based on the weight of the resulting blend polymer. The blend polymer chips were dried and were spun and drawn in the same manner as in Example 10 and thereby yielded a 84 dtex-48 filament drawn yarn having a round cross section. Table 3 shows the physical properties of the drawn yarn and demonstrates that it has markedly improved mechanical properties at 90° C. as compared with the conventional poly(lactic acid) fiber (Comparative Example 3). The drawn yarn had an elongation of 6% at 90° C. under a stress of 0.5 cN/dtex.

Comparative Example 8

A nylon 6 having a relative viscosity of 3.4 and the dried poly(lactic acid) used in Example 1 were melted and blended at 245° C. in a twin-screw extruder and thereby yielded blend polymer chips. The amount of nylon 6 was 10% by weight based on the total weight of the resulting blend polymer. The blend polymer chips were dried and were melted and spun in the same manner as in Example 10, except that the spinning temperature was changed to 245° C. During this procedure, the yarn frequently broke, since nylon 6 and the poly(lactic acid) have insufficient compatibility with each other. The reeled undrawn yarn 10 was pre-heated with the first hot roller 12 at a temperature of 90° C., was drawn at a draw ratio of 1.5, was heat-set with the second hot roller 13 at 130° C., was reeled by the unheated third roller 14 and thereby yielded a 100 dtex-36 filament drawn yarn 15 having a round cross section. The yarn was not satisfactorily drawn and frequently broke during drawing procedure. Table 3 shows the physical properties of the yarn and demonstrates that it has low strength at room temperature and poor mechanical properties at 90° C.

Comparative Example 9

In this example, poly(methyl methacrylate) (PMMA) as a polymer that can be completely dissolved with poly(lactic acid) and has a high $T_g$ was blended with the poly(lactic acid). Specifically, a PMMA (available from Sumitomo Chemical Co., Ltd., under the trade name of SUMIPEX LG21) and the dried poly(lactic acid) used in Example 7 were melted and blended at 220° C. in a twin-screw extruder and thereby yielded blend polymer chips. The amount of PMMA was 50% by weight based on the total weight of the resulting blend polymer. The blend polymer chips had $T_g$ of 75° C., much higher than that of homopoly(L-lactic acid), i.e., 60° C. The blend polymer chips were dried, were subjected to melt spinning at a spinning temperature of 220° C. in the same manner as in Example 10. The reeled undrawn yarn 10 was pre-heated with the first hot roller 12 at a temperature of 90° C., was drawn at a draw ratio of 1.7, was heat-set with the second hot roller 13 at 130° C., was reeled via the unheated third roller 14 and thereby yielded a 100 dtex-36 filament drawn yarn 15 having a round cross section. Table 3 shows the physical properties of the yarn and demonstrates that it has low strength at room temperature and poor mechanical properties at 90° C., indicating that increased $T_g$ of a polymer does not always contribute to improvement in mechanical properties at high temperatures.

Comparative Example 10

A blend polymer chips having $T_g$ of 66° C. were prepared by polymer blending procedure of Comparative Example 9, except that the amount of PMMA was changed to 30% by weight. The blend polymer chips were spun and drawn in the same manner as in Comparative Example 6, except that the draw ratio was changed to 2.8, and thereby yielded a 84 dtex-36 filament drawn yarn having a round cross section. Table 3 shows the physical properties of the drawn yarn and demonstrates that it has insufficient mechanical properties at 90° C., as in Comparative Example 9.

Comparative Example 11

An aliphatic polyester carbonate containing 14% of a carbonate unit and having a weight average molecular weight of 190000 was prepared by polymerization according to the procedure described in Example 2 of Japanese Unexamined Patent Application Publication No. 2000-109664. The aliphatic polyester carbonate and a dried homopoly(L-lactic acid) having an optical purity of 99% and a weight average molecular weight of 200000 were melted and blended at 240° C. in a twin-screw extruder and thereby yielded blend polymer chips having $T_g$ of 65° C. The amount of the aliphatic polyester carbonate was 50% by weight based on the total weight of the resulting blend polymer. The blend polymer chips were dried and were melted and spun in the same manner as in Example 10, except that the spinning temperature was changed to 240° C. During this procedure, the yarn frequently broke, since the aliphatic polyester carbonate and the poly(lactic acid) have insufficient compatibility with each other. The reeled undrawn yarn was pre-heated with the first hot roller 12 at a temperature of 90° C., was drawn at a draw ratio of 1.5, was heat-set with the second hot roller 13 at 130° C., was reeled via the unheated third roller 14 and thereby yielded a 100 dtex-36 filament drawn yarn 15 having a round cross section. The yarn was not satisfactorily drawn and frequently broke during drawing procedure. Table 3 shows the physical properties of the drawn yarn and demonstrates that it has low strength at room temperature and poor mechanical properties at 90° C.

Comparative Example 12

A dried nylon 11 having an intrinsic viscosity of 1.45 and the dried homopoly(L-lactic acid) used in Example 7 were melted separately and were subjected to spinning at 220° C. to yield a core-sheath conjugate yarn comprising nylon 11 as a core component and the homopoly(L-lactic acid) as a sheath component. The amount of nylon 11 herein was 20% by weight based on the total weight of the resulting conjugate yarn. The spun yarn was then drawn in the same manner as in Example 10 and thereby yielded a 84 dtex-24 filament drawn yarn having a round cross section. Table 3 shows the physical properties of the drawn yarn and demonstrates that it has low mechanical properties at 90° C.

Comparative Example 13

A 84 dtex-24 filament drawn yarn having a round cross section was prepared by the spinning and drawing procedures of Comparative Example 12, except that a poly (butylene terephthalate) having an intrinsic viscosity of 1.0 was used instead of nylon 11 and the spinning temperature was changed to 250° C. Table 3 shows the physical properties of the drawn yarn and demonstrates that it has low mechanical properties at 90° C.

Comparative Example 14

A 84 dtex-24 filament drawn yarn having a round cross section was prepared by the spinning and drawing procedures of Comparative Example 12, except that a poly (ethylene terephthalate) having an intrinsic viscosity of 0.65 was used instead of nylon 11 and the spinning temperature was changed to 290° C. Table 3 shows the physical properties of the drawn yarn and demonstrates that it has insufficient strength at room temperature and low mechanical properties at 90° C., since the poly(lactic acid) was significantly decomposed during spinning at a high temperature.

TABLE 3

Example 13

Figure 11:
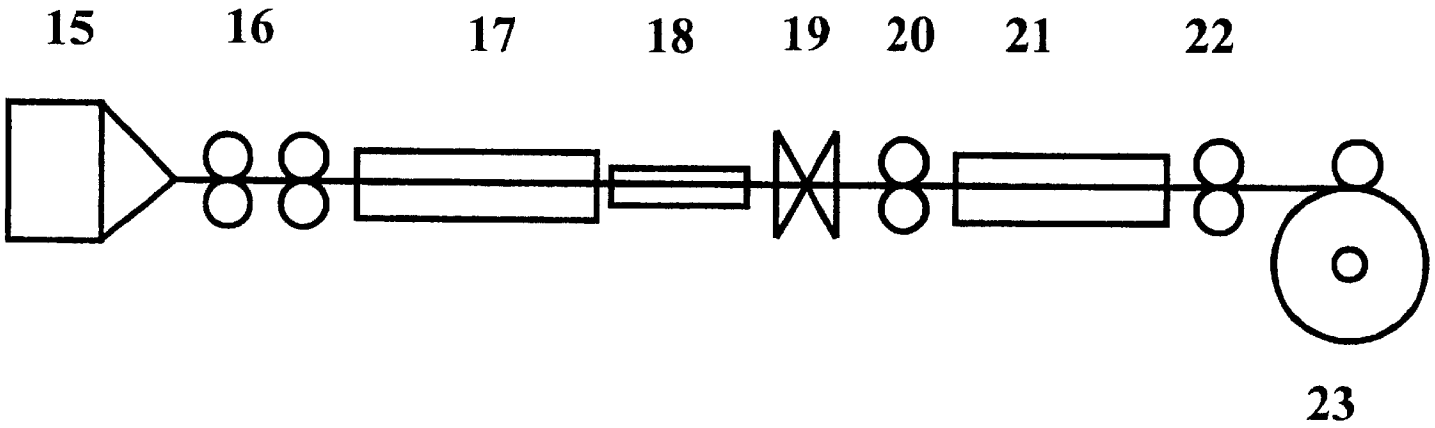
FIG. 11 schematically illustrates a draw false-twist texturing machine used in Examples 13 to 17 and Comparative Examples 15 to 17.

The poly(lactic acid) drawn yarn obtained in Example 2 was subjected to draw false-twist operation using the apparatus shown in FIG. 11 under the conditions indicated in Table 4. The speed of the drawing roller 20, i.e., the processing speed was set at 400 m/min, and the second heater 21 was not used. A triaxial twister was used as a false-twist rotor 19. Table 4 shows the physical properties of the resulting yarn and demonstrates that it has satisfactory strength at 90° C. and excellent crimp properties and boiling water shrinkage.

Example 14

Figure 14:
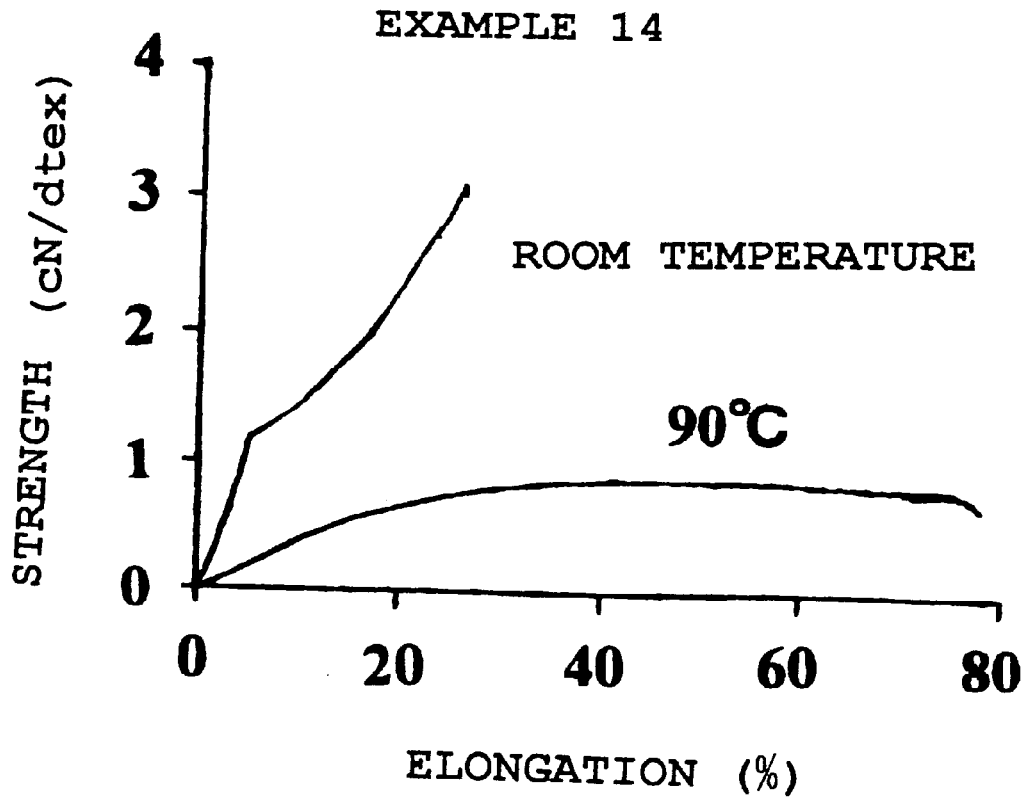
FIG. 14 illustrates a plot of strength versus elongation on a poly(lactic acid) crimped yarn (Example 14)

The undrawn yarn obtained in Example 2 was subjected to draw false-twist operation in the same manner as in Example 13 under the conditions indicated in Table 4. Table 4 shows the physical properties of the resulting draw false-twist yarn and demonstrates that it has satisfactory strength at 90° C. and excellent crimp properties and boiling water shrinkage. FIG. 14 shows the strength-elongation curve of the draw false-twist yarn.

Example 15

A false-twist yarn was prepared in the same manner as in Example 14, except that the temperature of the second heater 14 was set at 150° C. and a relax rate between a drawing roller 20 and a delivery roller 22 was set at 6%. Table 4 shows the physical properties of the false-twist yarn and demonstrates that it becomes resistant to shrinkage and has a low boiling water shrinkage of 6% by action of the second hater.

Example 16

The undrawn yarn obtained in Example 8 was subjected to draw false-twist operation in the same manner as in Example 15 under the conditions indicated in Table 4, except that a relax rate between the drawing roller 20 and a delivery roller 22 was set at 3%. Table 4 shows the physical properties of the false-twist yarn and demonstrates that it becomes resistant to shrinkage and has a low boiling water shrinkage of 7% by action of the second hater.

Example 17

The drawn yarn obtained in Example 10 was subjected to draw false-twist in the same manner as in Example 13 under the conditions indicated in Table 4. Table 4 shows the physical properties of the resulting false-twist yarn and demonstrates that it has satisfactory strength at 90° C. and excellent crimp properties and boiling water shrinkage.

Comparative Example 15

Figure 15:
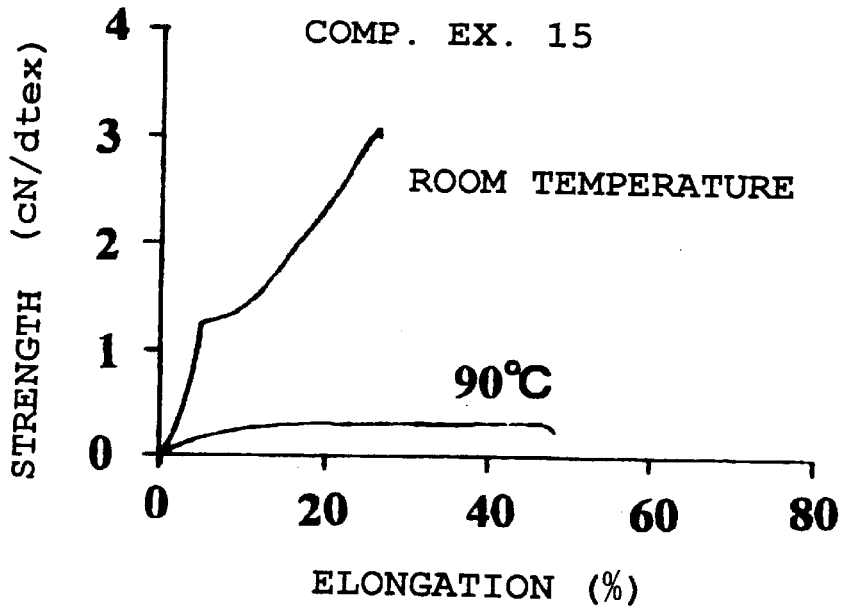
FIG. 15 illustrates a plot of strength versus elongation on a conventional poly(lactic acid) false-twist yarn (Comparative Example 15).

The conventional poly(lactic acid) fiber obtained in Comparative Example 3 was subjected to draw false-twist operation in the same manner as in Example 13 at a draw ratio of 1.5 and a heater temperature of 130° C., but the yarn broke on the heater 17 and could not be held by a thread guard. Next, the temperature of the heater 17 was reduced to 110° C. and the poly(lactic acid) fiber was again subjected to draw false-twist operation. In this case, the yarn could be reeled although the yarn was insufficiently held by the thread guard. The resulting false-twist yarn has a crimp rigidity CR of 20% but low strength at 90° C. FIG. 15 illustrates the strength-elongation curve of the false-twist yarn.

Comparative Example 16

The conventional poly(lactic acid) fiber obtained in Comparative Example 3 was subjected draw false-twist operation in the same manner as in Comparative Example 15, except that the temperature of the second heater 21 was set at 150° C. and the relax rate between the drawing roller 20 and the delivery roller 22 was set at 8%, and thereby yielded a false-twist yarn. Table 4 shows the physical properties of the false-twist yarn and demonstrates that it becomes resistant to shrinkage and has a low boiling water shrinkage of 8% by action of the second hater but it becomes nearly free of crimp to have a crimp rigidity CR of 3%. In addition, the false-twist yarn has low strength at 90° C.

Comparative Example 17

An undrawn yarn was prepared and reeled in the same manner as in Example 8 at a spinning speed of 3000 m/min. The wide angle X-ray diffractometry of the reeled undrawn yarn shows that it does not exhibit a crystalline pattern and is non-crystalline. The undrawn yarn had U % of 1.1% and an elongation at 25° C. of 97%. The undrawn yarn was subjected as a material yarn to draw false-twist operation in the same manner as in Example 13, but the yarn broke on the heater 17 and could not be held by a thread guard. Next, the temperature of the heater 17 was reduced to 110° C. and the poly(lactic acid) fiber was again subjected to draw false-twist operation. In this case, the yarn could be reeled although the yarn was insufficiently held by the thread guard. The resulting false-twist yarn has low strength at 90° C.

TABLE 4

Example 18

A plain weave fabric was prepared using the yarn obtained in Example 1 as the warp and weft. The warp was sized and dried at 110° C. without any troubles such as fluff and elongation of yarn. The plain weave fabric was scoured at 60° C. according to a conventional procedure, was subjected to pre-setting at 140° C., and was dyed at 110° C. according to a conventional procedure. The resulting fabric has satisfactory feel (texture) as apparel, such as the feel of rustle and a soft feel.

The yarns obtained according to Examples 2 to 17 were woven and the resulting plain woven fabrics were evaluated as fabrics in the same manner as above. Fluff, elongation of yarn and other troubles did not occur and the resulting fabrics satisfactory feel (texture) as apparel, such as the feel of rustle and a soft feel.

Comparative Example 18

A plain weave fabric was prepared in the same manner as in Example 18, except that the yarn obtained according to Comparative Example 3 was used as the warp and weft. In this procedure, the warp was. sized and dried at 110° C., but it elongated and could not be dried.

Example 19

The poly(lactic acid) used in Example 1 was blended homogeneously with 1% of ethylenebis(stearamide) as a lubricant in a twin-screw extruder at a kneading temperature of 230° C. and thereby yielded chips. The chips were melted and spun in the same manner as in Example 3 and thereby yielded an undrawn yarn. The undrawn yarn had a crystalline size in the (200) plane of 9.3 nm, a crystalline orientation of 0.96, U % of 0.8%, and an elongation at 25° C. of 43%. The undrawn yarn was then subjected to drawing and heat treatment in the same manner as in Example 3 and thereby yielded a drawn yarn. The drawn yarn had a satisfactory strength at 90° C. of 1.5 cN/dtex.

Example 20

An undrawn yarn was prepared by the melt spinning procedure of Example 19, except that the amount of ethylenebis(stearamide) was changed to 0.5%. The undrawn yarn had a crystalline size in the (200) plane of 9.2 nm, a crystalline orientation of 0.96, U % of 0.8%, and an elongation at 25° C. of 43%. The undrawn yarn was then subjected to drawing and heat treatment in the same manner as in Example 19 and thereby yielded a drawn yarn. The drawn yarn had a satisfactory strength at 90° C. of 1.5 cN/dtex.

Example 21

An undrawn yarn was prepared by the melt spinning procedure of Example 20, except that the amount of ethylenebis(stearamide) was changed to 3%. The undrawn yarn had a crystalline size in the (200) plane of 9.3 nm, a crystalline orientation of 0.96, U % of 0.8%, and an elongation at 25° C. of 43%. The undrawn yarn was then subjected to drawing and heat treatment in the same manner as in Example 19 and thereby yielded a drawn yarn. The drawn yarn had a satisfactory strength at 90° C. of 1.5 cN/dtex.

Example 22

The undrawn yarn obtained in Example 19 was subjected to the draw false-twist procedure of Example 15, except that the draw ratio was changed to 1.30. The resulting crimped yarn has satisfactory properties including a crimp rigidity CR of 22%, a strength at 25° C. of 2.9 cN/dtex, an elongation at 25° C. of 23%, a strength at 90° C. of 1.0 cN/dtex, a boiling water shrinkage of 4%, and U % of 1.0%.

TABLE 5

Example 23

Plain weave fabrics were prepared in the same manner as in Example 18 by using the poly(lactic acid) fibers obtained in Examples 19 to 22. The resulting fabrics were rubbed with a cotton cloth 300 times but they exhibit no becoming a cotton cloth colored and no fluff in them. And it had satisfactory wear resistance.

Comparative Example 19

Plain weave fabrics were prepared in the same manner as in Example 23 by using the poly(lactic acid) fibers obtained in Comparative Example 3. The resulting fabrics were rubbed with a cotton cloth 300 times in the same manner as in Example 23. It exhibits becoming a cotton cloth vigorously colored and many fluffs in it. And it had poor wear resistance.

While the present invention has been described with reference to what are presently considered to be the preferred embodiments, it is to be understood that the invention is not limited to the disclosed embodiments. On the contrary, the invention is intended to cover various modifications and equivalent arrangements included within the sprit and scope of the appended claims. The scope of the following claims is to be accorded the broadest interpretation so as to encompass all such modifications and equivalent structures and functions.

TABLE 1

| | Spinning speed (m/min) | 1 HR (° C.) | Draw ratio | E | 2 HR (° C.) | $3_1$ Ratio (%) | $3_1$ Crystal | U% (%) | Strength at 25° C. (cN/dtex) | Elongation at 25° C. (%) | Strength at 90° C. (cN/dtex) | Creep rate at 90° C. (%) | SW (%) |
|---|---|---|---|---|---|---|---|---|---|---|---|---|---|
| Ex. 1 | 5000 | 140 | 1.84 (1.34 + E) | 0.50 | 130 | 29 | yes | 1.0 | 6.1 | 19 | 2.1 | 4 | 9 |
| Ex. 2 | 5000 | 140 | 1.50 (1.00 + E) | 0.50 | 130 | 17 | no | 0.9 | 3.8 | 30 | 1.3 | 11 | 7 |
| Ex. 3 | 6000 | 90 | 1.44 (1.01 + E) | 0.43 | 130 | 12 | no | 1.2 | 4.2 | 22 | 1.3 | 11 | 4 |
| Ex. 4 | 6000 | 140 | 1.75 (1.32 + E) | 0.43 | 150 | 33 | yes | 1.0 | 5.7 | 18 | 2.1 | 4 | 6 |
| Ex. 5 | 4000 | 110 | 1.60 (0.88 + E) | 0.72 | 130 | 10 | no | 1.0 | 3.3 | 40 | 0.8 | 15 | 5 |
| Ex. 6 | 3000 | 140 | 2.05 (1.10 + E) | 0.95 | 130 | 18 | yes | 1.2 | 4.8 | 22 | 2.2 | 5 | 10 |
| Com. Ex. 1 | 2200 | three-stage drawing | (first stage: 0.33 + E) | 1.20 | 130 | 0 | no | 1.8 | 7.0 | 27 | 0.7 | 7 | 8 |
| Com. Ex. 2 | 400 | 120 | 4.90 (2.40 + E) | 2.50 | 125 | 0 | no | 5.2 | 7.5 | 30 | 0.4 | — | 17 |
| Com. Ex. 3 | 1500 | 90 | 2.40 (0.75 + E) | 1.65 | 130 | 0 | no | 2.9 | 3.6 | 50 | 0.3 | — | 11 |

TABLE 1-continued

| | Spinning speed (m/min) | 1 HR (° C.) | Draw ratio | E | 2 HR (° C.) | $3_1$ Ratio (%) | $3_1$ Crystal | U% (%) | Strength at 25° C. (cN/dtex) | Elongation at 25° C. (%) | Strength at 90° C. (cN/dtex) | Creep rate at 90° C. (%) | SW (%) |
|---|---|---|---|---|---|---|---|---|---|---|---|---|---|
| Com. Ex. 4 | 5000 | undrawn yarn | | | | 0 | no | 0.8 | 2.4 | 50 | 0.4 | — | 18 |

1 HR: First hot roller temperature, 2 HR: Second hot roller temperature
Draw ratio: The ratio of peripheral speed of the second hot roller to that of the first hot roller
E: [Elongation (%) of undrawn yarn]/100
$3_1$ Ratio (%): The ratio of $3_1$ helical structure to the total fiber as determined by solid-state NMR
$3_1$ Crystal: The presence of a crystal of the $3_1$ helical structure as determined by WAXD
SW: Boiling water shrinkage

TABLE 2

| | 1 HR (° C.) | Draw ratio | E | 2 HR (° C.) | $3_1$ Ratio (%) | $3_1$ Crystal | U% (%) | Strength at 25° C. (cN/dtex) | Elongation at 25° C. (%) | Strength at 90° C. (cN/dtex) | Creep rate at 90° C. (%) | SW (%) |
|---|---|---|---|---|---|---|---|---|---|---|---|---|
| Ex. 7 | 140 | 1.50 (1.03 + E) | 0.47 | 130 | 16 | no | 0.9 | 3.4 | 35 | 1.0 | 12 | 7 |
| Ex. 8 | 130 | 1.75 (1.26 + E) | 0.49 | 150 | 25 | yes | 1.0 | 5.6 | 20 | 1.9 | 5 | 5 |
| Ex. 9 | 130 | 1.67 (1.21 + E) | 0.46 | 150 | 24 | yes | 1.2 | 5.2 | 20 | 1.7 | 5 | 5 |

1 HR: First hot roller temperature, 2 HR: Second hot roller temperature
Draw ratio: The ratio of peripheral speed of the second hot roller to that of the first hot roller
E: [Elongation (%) of undrawn yarn]/100
$3_1$ Ratio (%): The ratio of $3_1$ helical structure to the total fiber as determined by solid-state NMR
$3_1$ Crystal: The presence of a crystal of the $3_1$ helical structure as determined by WAXD
SW: Boiling water shrinkage

TABLE 3

| | Strength at 25° C. (cN/dtex) | Elongation at 25° C. (%) | Strength at 90° C. (cN/dtex) | Creep rate at 90° C. (%) | SW (%) | U% (%) |
|---|---|---|---|---|---|---|
| Ex. 10 | 3.0 | 45 | 1.0 | 8 | 5 | 1.0 |
| Ex. 11 | 2.6 | 40 | 1.0 | 6 | 7 | 1.0 |
| Ex. 12 | 3.1 | 42 | 1.0 | 7 | 9 | 1.0 |
| Com. Ex. 8 | 1.9 | 72 | 0.3 | broken | 6 | 4.5 |
| Com. Ex. 9 | 2.3 | 70 | 0.3 | broken | 13 | 2.5 |
| Com. Ex. 10 | 2.7 | 63 | 0.4 | broken | 11 | 2.1 |
| Com. Ex. 11 | 1.8 | 75 | 0.3 | broken | 10 | 3.5 |
| Com. Ex. 12 | 2.8 | 60 | 0.4 | broken | 7 | 2.3 |
| Com. Ex. 13 | 3.1 | 62 | 0.4 | broken | 7 | 1.5 |
| Com. Ex. 14 | 1.7 | 45 | 0.5 | broken | 5 | 2.5 |

SW: Boiling water shrinkage

TABLE 4

| | Material yarn | 1 H (° C.) | Draw ratio | 2 H (° C.) | CR (%) | Strength at 25° C. (cN/dtex) | Elongation at 25° C. (%) | Strength at 90° C. (cN/dtex) | SW (%) | U% (%) |
|---|---|---|---|---|---|---|---|---|---|---|
| Ex. 13 | drawn yarn of Ex. 2 | 130 | 1.10 | — | 25 | 3.5 | 19 | 0.9 | 5 | 0.9 |
| Ex. 14 | undrawn yarn of Ex. 2 | 130 | 1.30 | — | 24 | 3.0 | 22 | 0.8 | 15 | 0.9 |
| Ex. 15 | undrawn yarn of Ex. 2 | 130 | 1.30 | 150 | 20 | 2.8 | 24 | 0.9 | 6 | 1.0 |
| Ex. 16 | undrawn yarn of Ex. 8 | 130 | 1.30 | 150 | 15 | 2.8 | 25 | 0.8 | 7 | 1.0 |
| Ex. 17 | drawn yarn of Ex. 10 | 140 | 1.05 | — | 35 | 2.8 | 45 | 1.0 | 6 | 1.0 |
| Com. Ex. 15 | drawn yarn of Com. Ex. 3 | 110 | 1.50 | — | 20 | 3.0 | 25 | 0.4 | 25 | 2.1 |
| Com. Ex. 16 | drawn yarn of Com. Ex. 3 | 110 | 1.50 | 150 | 3 | 2.8 | 28 | 0.1 | 8 | 2.5 |
| Com. Ex. 17 | yarn spun at 3000 m/min | 110 | 1.50 | — | 10 | 2.5 | 29 | 0.1 | 28 | 2.7 |

TABLE 4-continued

| Material yarn | 1 H (° C.) | Draw ratio | 2 H (° C.) | CR (%) | Strength at 25° C. (cN/dtex) | Elongation at 25° C. (%) | Strength at 90° C. (cN/dtex) | SW (%) | U% (%) |
|---|---|---|---|---|---|---|---|---|---|

1 H: First heater temperature, 2 H: Second heater temperature
Draw ratio: The ratio of peripheral speed of the drawing roller to that of the feed roller
SW: Boiling water shrinkage

TABLE 5

| | 1 HR (° C.) | Draw ratio | E | 2 HR (° C.) | $3_1$ Ratio (%) | $3_1$ Crystal | U% (%) | Strength at 25° C. (cN/dtex) | Elongation at 25° C. (%) | Strength at 90° C. (cN/dtex) | Creep rate at 90° C. (%) | SW (%) |
|---|---|---|---|---|---|---|---|---|---|---|---|---|
| Ex. 19 | 90 | 1.44 (1.01 + E) | 0.43 | 130 | 13 | no | 1.0 | 4.3 | 24 | 1.5 | 9 | 4 |
| Ex. 20 | 90 | 1.44 (1.01 + E) | 0.43 | 130 | 12 | no | 1.0 | 4.2 | 22 | 1.5 | 9 | 4 |
| Ex. 21 | 90 | 1.44 (1.01 + E) | 0.43 | 130 | 14 | no | 1.2 | 4.1 | 22 | 1.5 | 9 | 4 |

1 HR: First hot roller temperature, 2 HR: Second hot roller temperature
Draw ratio: The ratio of peripheral speed of the second hot roller to that of the first hot roller
E: [Elongation (%) of undrawn yarn]/100
$3_1$ Ratio (%): The ratio of $3_1$ helical structure to the total fiber as determined by solid-state NMR
$3_1$ Crystal: The presence of a crystal of the $3_1$ helical structure as determined by WAXD
SW: Boiling water shrinkage

What is claimed is:

1. A poly(lactic acid) fiber having a strength at 90° C. of equal to or more than 0.8 cN/dtex, Uster unevenness of less than or equal to 1.5% and a creep rate at 90° C. of less than or equal to 15%.

2. The poly(lactic acid) fiber according to claim 1, having a strength at 25° C. of equal to or more than 2.0 cN/dtex.

3. The poly(lactic acid) fiber according to claim 1, having a boiling water shrinkage of from 0% to 20%.

4. The poly(lactic acid) fiber according to claim 1, having an elongation at 25° C. of from 15% to 70%.

5. The poly(lactic acid) fiber according to claim 1, having a strength at 25° C. of equal to or more than 3.5 cN/dtex.

6. The poly(lactic acid) fiber according to claim 1, having a strength of 90° C. of equal to or more than 1.0 cN/dtex.

7. The poly(lactic acid) fiber according to claim 1, exhibiting Uster unevenness of less than or equal to 1.2%.

8. The poly(lactic acid) fiber according to claim 1, having a creep rate of 90° C. of less than or equal to 10%.

9. The poly(lactic acid) fiber according to claim 1, comprising a lactic acid monomer in an amount equal to or more than 50% by weight.

10. The poly(lactic acid) fiber according to claim 1, comprising a lactic acid monomer in an amount equal to or more than 96% by weight.

11. The poly(lactic acid) fiber according to claim 1, comprising a poly (D- or L-lactic acid) molecular chain constituting a $3_1$ helical structure by itself.

12. The poly(lactic acid) fiber according to claim 1 wherein the integrated intensity of a peak corresponding to a $3_1$ helical structure ($3_1$ ratio) is equal to or more than 12% of that of peaks observed at 165 to 175 ppm in solid state $^{13}$C-NMR spectrum.

13. The poly(lactic acid) fiber according to claim 1, comprising a blend of a poly(lactic acid) and 5% to 40% by weight of an aromatic polyester.

14. The poly(lactic acid) fiber according to claim 13 wherein the aromatic polyester is crystalline and has a melting point of from 170° C. to 250° C.

15. The poly(lactic acid) fiber according to claim 13 wherein the blend constitutes an island-in-sea structure at least partially comprising islands each having a size of 0.001 to 1 μm in terms of diameter.

16. The poly(lactic acid) fiber according to claim 13 wherein the blend constitutes a co-continuous structure.

17. The poly(lactic acid) fiber according to claim 1, further comprising a lubricant.

18. The poly(lactic acid) fiber according to claim 1 wherein the lubricant is a carboxylic amide.

19. The poly(lactic acid) fiber according to claim 1 wherein the lubricant is ethylenebis (stearamide).

20. A fibrous article comprising at least the poly(lactic acid) fiber as claimed in claim 1.

21. A process for producing a poly(lactic acid) crimped yarn, comprising the step of crimping the poly(lactic acid) fiber as claimed in claim 1.

22. A fibrous article comprising at least the poly(lactic acid) crimped yarn obtained by the process as claimed in claim 21.

23. A poly(lactic acid) fiber having a strength at 90° C. of equal to or more than 0.8 cN/dtex and a crimp rigidity (CR) of equal to or more than 10%, and further comprising a lubricant.

24. The poly(lactic acid) fiber according to claim 23, having Uster unevenness of less than or equal to 1.5%.

25. The poly(lactic acid) fiber according to claim 23, having a strength at 25° C. of equal to or more than 2.0 cN/dtex.

26. The poly(lactic acid) fiber according to claim 23, having a boiling water shrinkage of from 0% to 20%.

27. The poly(lactic acid) fiber according to claim 23, having an elongation at 25° C. of from 15% to 70%.

28. The poly(lactic acid) fiber according to claim 23, having a strength at 25° C. of equal to or more than 3.5 cN/dtex.

29. The poly(lactic acid) fiber according to claim 23, exhibiting Uster unevenness of less than or equal to 1.2%.

30. The poly(lactic acid) fiber according to claim 23 to 29, comprising a lactic acid monomer in an amount equal to or more than 50% by weight.

31. The poly(lactic acid) fiber according to claim 23, comprising a lactic acid monomer in an amount equal to or more than 96% by weight.

32. The poly(lactic acid) fiber according to claim 23, comprising a blend of a poly(lactic acid) and 5% to 40% by weight of an aromatic polyester.

33. The poly(lactic acid) fiber according to claim 32 wherein the aromatic polyester is crystalline and has a melting point of from 170° C. to 250° C..

34. The poly(lactic acid) fiber according to claim 32 wherein the blend constitutes an island-in-sea structure at least partially comprising islands each having a size of 0.001 to 1 $\mu$m in terms of diameter.

35. The poly(lactic acid) fiber according to claim 32 wherein the blend constitutes a co-continuous structure.

36. The poly(lactic acid) fiber according to claim 23, having a crimp rigidity (CR) of equal to or more than 15%.

37. The poly(lactic acid) fiber according to claim 23, wherein the crimp rigidity is equal to or more than 20%.

38. The poly(lactic acid) fiber according to claim 23 wherein the lubricant is a carboxylic amide.

39. The poly(lactic acid) fiber according to claim 23 wherein the lubricant is ethylenebis (stearamide).

40. A fibrous article comprising at least the poly(lactic acid) fiber as claimed in claim 23.

* * * * *

UNITED STATES PATENT AND TRADEMARK OFFICE

CERTIFICATE OF CORRECTION

PATENT NO. : 6,761,970 B2
DATED : July 13, 2004
INVENTOR(S) : Ochi et al.

It is certified that error appears in the above-identified patent and that said Letters Patent is hereby corrected as shown below:

Column 28,
Lines 35 and 36, please change “claim 1” to -- claim 17 --.

Signed and Sealed this

Twenty-fifth Day of January, 2005

JON W. DUDAS
*Director of the United States Patent and Trademark Office*